US011814273B2

(12) United States Patent
Dissing

(10) Patent No.: US 11,814,273 B2
(45) **Date of Patent: *Nov. 14, 2023**

(54) DEVICE FOR POSITIONING AN OBJECT RELATIVELY TO A SUPPORT BY AN INFLATABLE AIR CUSHION MEMBER IN COMBINATION WITH A SUPPORT BLOCK

(71) Applicant: Dissing A/S, Skanderborg (DK)

(72) Inventor: Claus Hornstrup Dissing, Ry (DK)

(73) Assignee: DISSING A/S, Skanderborg (DK)

( * ) Notice: Subject to any disclaimer, the term of this patent is extended or adjusted under 35 U.S.C. 154(b) by 0 days.

This patent is subject to a terminal disclaimer.

(21) Appl. No.: 17/841,739

(22) Filed: Jun. 16, 2022

(65) Prior Publication Data

US 2022/0388820 A1 Dec. 8, 2022

Related U.S. Application Data

(62) Division of application No. 16/348,533, filed on May 9, 2019, now Pat. No. 11,383,961.

(51) Int. Cl.

| | |
|---|---|
| ***B66F 3/00*** | (2006.01) |
| ***B66F 3/35*** | (2006.01) |
| ***E04F 21/00*** | (2006.01) |
| ***E04F 21/18*** | (2006.01) |

(52) U.S. Cl.
CPC ..... *B66F 3/35* (2013.01); *E04F 21/0023* (2013.01); *E04F 21/18* (2013.01)

(58) Field of Classification Search
CPC ..... B66F 1/00; B66F 3/00; B66F 5/00; B66F 3/35; B25B 11/00; B25B 11/005
See application file for complete search history.

(56) References Cited

U.S. PATENT DOCUMENTS

| | | | | |
|---|---|---|---|---|
| 3,346,885 | A | 10/1967 | Merriman | |
| 4,060,170 | A | 11/1977 | Walters | |
| 4,372,533 | A | 2/1983 | Knaus | |
| 5,506,012 | A | 4/1996 | Wright | |
| 5,669,086 | A | 9/1997 | Garman | |
| 7,762,362 | B2 | 7/2010 | Cutkosky | |
| 8,882,996 | B2 | 11/2014 | Day | |
| 9,912,035 | B2 | 3/2018 | Froehler et al. | |
| 11,383,961 | B2 * | 7/2022 | Dissing | E04F 21/0023 |
| 2005/0132490 | A1 | 6/2005 | Davis | |
| 2007/0210542 | A1 | 9/2007 | Hammond | |

(Continued)

FOREIGN PATENT DOCUMENTS

| | | | |
|---|---|---|---|
| AU | 2015365265 | A1 | 10/2016 |
| CN | 101094639 | A | 12/2007 |

(Continued)

OTHER PUBLICATIONS

Search Report from Chinese Patent App. No. 2021111342303 (dated Aug. 23, 2022).

*Primary Examiner* — Lee D Wilson
(74) *Attorney, Agent, or Firm* — Cermak Nakajima & McGowan LLP; James Creighton Wray

(57) ABSTRACT

The device comprises a combination of an inflatable air cushion member of a flexible but non-stretchable air tight sheet material and a support block. The inflatable air cushion member is formed as a bag unit comprising opposite layers of said sheet material provided face to face and joined along an edge area to form a double layer edge.

15 Claims, 20 Drawing Sheets

(56) References Cited

U.S. PATENT DOCUMENTS

| | | | | |
|---|---|---|---|---|
| 2008/0169003 | A1 | 7/2008 | Curtis | |
| 2014/0272272 | A1 | 9/2014 | Spenko | |
| 2016/0325971 | A1* | 11/2016 | Dissing | E04F 21/0007 |
| 2020/0002141 | A1* | 1/2020 | Dissing | E04F 21/18 |
| 2022/0388820 | A1* | 12/2022 | Dissing | E04F 21/18 |

FOREIGN PATENT DOCUMENTS

| | | | |
|---|---|---|---|
| CN | 202899635 | U | 4/2013 |
| CN | 203269460 | U | 11/2013 |
| CN | 104703710 | A | 6/2015 |
| DE | 1265377 | B | 4/1968 |
| DE | 96047 | A5 | 3/1973 |
| DE | 7329494 | U | 11/1973 |
| DE | 8312004 | U1 | 9/1983 |
| DE | 102015101290 | B3 | 5/2016 |
| DK | 177510 | B1 | 8/2013 |
| FR | 1282755 | A | 1/1962 |
| FR | 2380773 | A1 | 9/1978 |
| GB | 1512703 | A | 6/1978 |
| GB | 2192232 | A | 1/1988 |
| GB | 2286430 | A | 8/1995 |
| GB | 2373025 | A | 9/2002 |
| JP | H01118992 | A | 5/1989 |
| JP | H07137995 | A | 5/1995 |
| WO | 9513448 | A1 | 5/1995 |
| WO | WO2016/019965 | A1 | 2/2016 |
| WO | 2016058615 | A1 | 4/2016 |
| WO | WO2016/058614 | A1 | 4/2016 |

* cited by examiner

FIG. 6A
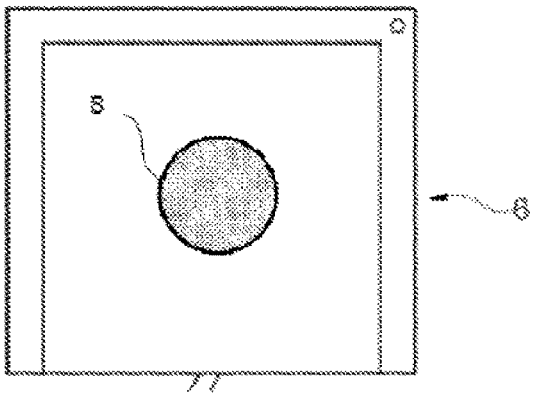
FIG 6b
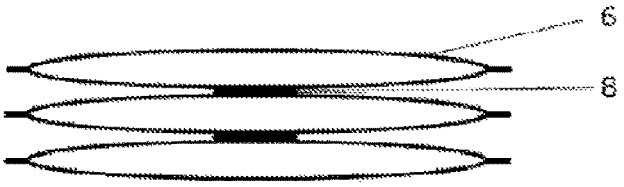
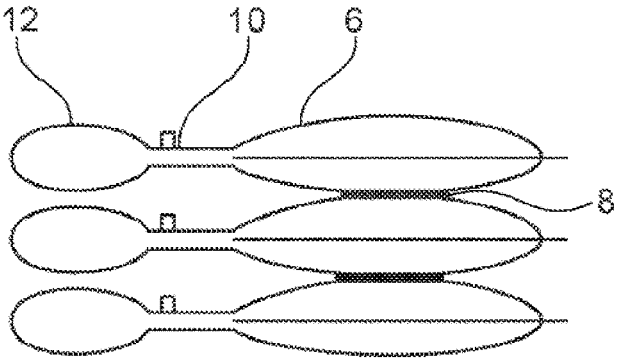
FIG. 6C
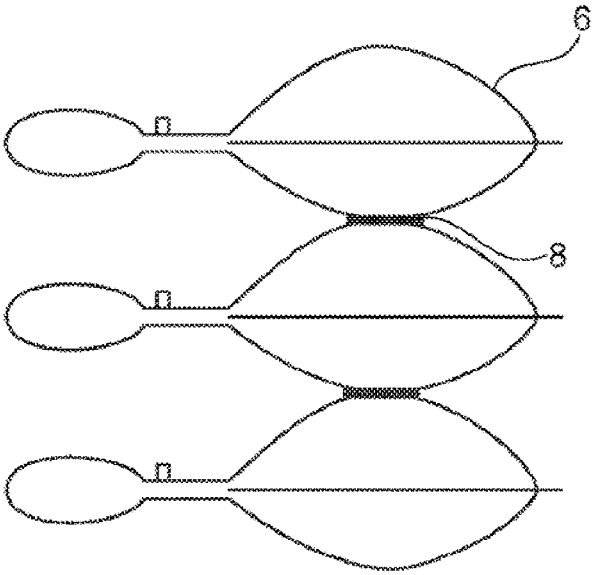
FIG. 6D

DEVICE FOR POSITIONING AN OBJECT RELATIVELY TO A SUPPORT BY AN INFLATABLE AIR CUSHION MEMBER IN COMBINATION WITH A SUPPORT BLOCK

This application is a division of application Ser. No. 16/348,533 filed May 9, 2019, which claims the benefit of U.S. Provisional Application No. 62/420,638 filed Nov. 11, 2016, Danish Application No. PA 2016 70897 filed Nov. 11, 2016 and PCT/DK2017/050368 filed Nov. 10, 2017, International Publication No. WO 2018/086668 A1, which are hereby incorporated by reference in their entirety as if fully set forth herein.

FIELD OF THE INVENTION

The present invention relates to devices with inflatable air cushion members for positioning an object, such as furniture, windows, or doors, relatively to a supporting surface, for example a floor or wall, and method for operating such device. The air cushion members are made of a flexible but not readily stretchable air tight sheet material in hose-connection with an inflation tool. The inflatable air cushion member is formed as a bag unit comprising opposite layers of said sheet material provided face to face and joined along an edge area to form a reinforced double layer edge. The bag unit is flat in deflated condition and attains a rounded form when inflated. The invention also relates to a method of operating the device, and a method for moving an object with such device.

BACKGROUND OF THE INVENTION

In International patent application WO95/13448, an auxiliary tool and a use of the tool is disclosed for adjusting the position of frames, for example doors and windows, in buildings by placing inflatable cushion members on either side of the frame within a corresponding opening in a wall, potentially supported by wedges. As illustrated in FIG. 1*a*, the cushion member 6 is formed as a flat bag unit with two layers of a tough and flexible but not readily stretchable sheet material 1 placed face to face and joined along an edge region 4, for example by a welding 22. The air cushion member 6 comprises a folded rectangular piece of a sheet material such that a fold 24 constitutes one edge of the rectangle and the remaining edge region 4 constitutes three other edges of the rectangle. At the fold 24, there is provided a foot piece of an outwardly protruding bendable connector piece 10 for connection to an inflation balloon 12 comprising an intake valve 14. The balloon 12 is manually operated by squeezing of the balloon by hand for pumping. At the balloon 12, a deflation valve 16 is provided with an actuator button 18 for deflation. At a corner portion of the edge region 4 a hole 20 is provided.

A product of this type is marketed as Winbag™ and described on the Internet site http://www.winbag.dk/en/. As illustrated in FIG. 1B, three states of a marketed inflatable cushion member of the above type is shown in side perspective, the upper image shows the cushion member non-inflated, the middle image shows the cushion member normally inflated, and the lower image shows the cushion member heavily inflated. As marketed cushion member of this type are relatively small, typically with about 15±1 cm long edges, and made of a heavy duty reinforced material, extensive inflation as in the lower image of FIG. 1B requires high pressure and is only achievable with high manual pumping force exerted on the balloon.

A typical height after manual pumping is 4-6 cm when the cushion member is used for lifting objects/elements with a weight of 50-100 kg. The necessary pressure inside such cushion in order to lift a 100 kg object by 4 cm is typically between 1 and 1.3 bar. At higher pressure, the cushion member can become thicker during lifting action of 50-100 kg, for example up to 5-6 cm. However, many users do not have sufficient hand force to achieve this state of the cushion member, when it is used for lifting heavy material, as it would require a pressure in excess of 1 bar, for example between 1 bar and 1.6 bars, or even up to 2 bars. The result of the low pressure by manual pumping is in many cases an insufficient height of 2-3 centimeters when lifting an object of 50 kg or more.

For example, the cushion member is configured to lift a load to a height of 5 mm for 100 kg at 0.65 bar, 150 kg at 1 bar, 200 kg at 1.4 bar, and 225 kg at 1.6 bar. The values are within 20%, for example within 10%. However, 5 mm is typically too little for a proper lift and adjustment of the load.

A test was performed with the inflatable cushion when being inflated to a pressure of 1.8 bar, which is only manually possible for very strong men and not possible for the average user. The following heights of the cushion member were measured in dependence of the weight of the load on the cushion member: 5.8 cm at 70 kg, 5.0 cm at 85 kg, 4.3 cm at 122 kg, 3.6 cm at 155 kg, 2.7 cm at 197 kg, 2.4 cm at 211 kg, 2.0 cm at 323 kg, It is seen that the relationship at 1.8 bar is largely linear between 70 and 211 kg.

In Danish patent DK177510B1 by Dueholm, a different type of inflatable cushion member is disclosed, where a height adjustment mechanism is disclosed comprising a number of flat polymer foam plates with different thickness which can be used as support for the cushion member. In order for the cushion member to slide easily on a smooth floor or on carpet, a Plexiglas plate is provided with one smooth side and one side covered with small polymer loops of the Velcro™ type. Although, the polymer foam slabs are increasing the height, in practice, it is difficult to maintain the entire stack of sliding plate, polymer foam plate and cushion member, one on top of the other when pushing it underneath an object and when inflating the cushion member manually, as the latter introduces push and pull during the manual pumping operation. Also, when dragging or pushing the arrangement of Plexiglas plate, polymer foam plate, and cushion member, while having an object lifted with it, the arrangement has a tendency to become unstable, and the polymer foam plates and the cushion member are likely to slide or roll down from the Plexiglas plate, which makes this arrangement dangerous when used in practice.

Although, the prior art cushion members are helpful for lifting and adjusting frames in wall openings or lifting objects, the full potential of such cushion members appear not to have reached final limits, and there is a general desire of extending the versatility in order to broaden the range of applications. Especially, it would be desirable to provide means to optimize the cushion member to the actual specific use, be it for preventing sliding as in the above mentioned WO95/13448 or for dragging a lifted object across a floor as proposed in the above mentioned DK177510B1.

DESCRIPTION/SUMMARY OF THE INVENTION

It is therefore an objective of the invention to provide a general improvement in the art. Especially, it is an objective to provide a device with inflatable air cushion members for positioning an element relatively to a surface, for example vertical or horizontal surface, and method for operating such device, where the device is more versatile and adaptable than the prior art. These and further objectives are achieved with a method and device for positioning an element relatively to a surface as described in the following.

The inflatable air cushion member used for the invention is formed as a bag unit comprising opposite layers of air tight sheet material provided face to face and joined along an edge area to form a double layer edge. The sheet material is flexible but nonstretchable sheet material, typically polymer material. The cushion member is in hose-connection with an inflation tool and flat in deflated condition. It attains increasing thickness in dependence of the air pressure in it until a certain maximum thickness. The inflation tool comprising a hose and an air pump, for example a hand operated balloon, a bellows, for example foot-operated, or an electrical air pump, and potentially further hoses, valves, regulators, and manifolds in dependence of the actual need. Typical dimensions of the inflatable cushion are within 10 and 30 cm when in non-inflated condition, for example with a rectangular, square, oval or round shape. For example, the inflatable cushion has a rectangular shape with an edge length of 12-17 cm, especially with 15±1 cm long edges. Typically, the cushion member in deflated conditions has a flat sheet area within a circumscribed circle with a diameter of less than 50, or even less than 40 cm, for example a diameter of 35 or 30 cm. For example, it is similar to the inflatable cushion member as described above with reference to WO95/13448.

The glued or welded, for example ultrasonic welded, polymer sheet material, typically, has a thickness of less than 2 mm, for example in the region of 1.4 to 1.8 mm The sheet material of the cushion is a polymer foil, typically reinforced by fibres, for example by glass, carbon, or polymer fibres. In some embodiments, the sheet material is similar to a tarpaulin material. Examples of useful enforcing polymer fibres are high density polyethylene fibres. Other re-enforcing fibres are marketed as Kevlar® (Aramid carbon), Dyneema® (Ultra High Molecular Weight Polyethylene), Tedlar® (polyvinyl fluoride), and Vectran® (liquid crystal polymer), Spectra® (polyethylene), and Zylon® (liquid-crystalline polyoxazole).

The cushion member is, optionally, of the type of a folded sheet with three edges that are welded or glued together. However, this need not be the case. Alternatively, the cushion member is made of two sheets, for example different types of sheets, which are joined along the edge, in case of oval or round shape, or edges in case of polygonal shape, for example rectangular.

In the following a number of improvements are provided which can be used alone or in combination.

An Electrical Pump

The relatively small cushion member with flat sheet area within a circumscribed circle with dimeter of 30 cm is, in some embodiments, provided with a hand operated balloon which, as discussed above, limits the pressure to, typically, less than 1 bar and implies a height in the order of 5 cm. In order to increase the height further, strong hand pumping needs to be applied.

In order to provide an improvement and ease operation by the user, the balloon is substituted by a small electrical battery-powered air pump. The electrical pump is connected to the cushion member by the hose-connection similarly as the prior art balloon connection. The term small for the pump is used here as indicating dimensions that are easily hand held and transported as minor additional part to the cushion member. Dimensions of the pump are less than the sheet dimensions, which is within 10-20 cm along an edge, if rectangular. For example, the pump has a length of less than 10 cm and a width of less than 5 cm.

The electrical pump has a pump capacity providing a pressure of more than 1 bar and up to at least 1.5 bars, for example up to 2 bars. Such pressure is higher than normally operable by hand with a manually operated balloon and below the pressure that is critical for a cushion member with the above stated dimensions and parameters.

This pressure causes the inflatable cushion of rectangular size with an edge length of 12-18 cm, especially with 15±1 cm long edges, to attain a very rounded shape, for example a height of more than 6 cm, and optionally, up to 7 cm even when carrying a load of 100 kg.

As already mentioned, the cushion members can have other shapes than rectangular, for example circular or oval shapes. Typically, the sheets have dimensions within a circumscribed circle with a diameter of less than 50 cm, or even less than 40 cm, for example a circumscribed circle with a diameter of 30 cm.

Surface Type With Various Levels of Friction

In the following, the surface of the device with the cushion for positioning an object relatively to a surface is adjusted in order to optimize the device for specific purposes. In the following, the terminology of high-friction and low-friction is used.

The term high-friction surface is used for the following characteristics of surfaces, the list not being exclusive and the characteristics optionally combined: [0024] a soft-polymer surface, for example silicone surface, optionally smooth surface; [0025] a rubber surface, for example synthetic rubber or natural rubber; [0026] a corrugated or knobbed polymer surface, optionally rubber surface; [0027] a rough polymer surface, the surface having a roughness of more than 0.3 mm, optionally rubber surface; [0028] a surface with a static coefficient of friction against glass of more than 1, for example more than 2; [0029] a surface with a dynamic coefficient of friction against glass higher than 0.4, for example higher than 0.6 or 0.8.

The term low friction surface is used for the following characteristics of surfaces, the list not being exclusive and the characteristics, optionally combined: [0031] a smooth fabric surface, for example woven or knitted or compressed non-woven, optionally made of nylon (polyamide), for example ballistic nylon, Ultra High Molecular Weight Polyethylene, for example Dyneema®, High Molecular Weight Polyethylene, Kevlar® (Aramid carbon), Tedlar® (polyvinyl fluoride), Vectran® (liquid crystal polymer), Spectra® (polyethylene), or Zylon® (liquid-crystalline polyoxazole); [0032] a smooth polymer film surface other than soft-polymer, rubber or silicone, optionally polyethylene, polypropylene, polyester, or polyamide; [0033] a surface with a static coefficient of friction against glass of lower than 1 for example lower than 0.8 or 0.6; [0034] a surface with a dynamic coefficient of friction against glass less than 0.4, for example lower than 0.2.

It is pointed out that the static friction coefficient of glass against glass is 1 and the corresponding dynamic coefficient is 0.4.

An improvement over the prior art with respect to versatility and adaptability is achieved by providing the device, for example the cushion member itself, with opposite sides having different friction coefficient. In this regard, it is pointed out that the friction coefficient itself depends on the surface of a support against which the device is placed and against which such friction is measured, for example glass, floor tiles, or a carpet. However, in case of doubt of how to determine the friction coefficient of the device, a glass support is used as a reference.

An improvement over the prior art is a method of providing one side or both sides of the device with a high-friction or a low friction surface on the outside. In some embodiment, one side is provided with a high-friction surface and one side is provided with a low-friction surface. For example, the sheet material of the cushion member itself is provided with such high-friction or low-friction surface as desired, or a sleeve is provided into which the cushion member is inserted, wherein the sleeve member has the desired surface characteristics. Examples thereof are given in the following.

A Cushion Member With Various Surface Features

Typically, a cushion member is provided with a sheet material that comprises a laminate, similar to a tarpaulin material, with a fabric that is sandwiched between polymer layers or a fabric that is fused with a single film layer of polymer on one of its two sides. Instead of a laminate, optionally, the film layer on one or both sides of the fabric is provided by coating a molten thermoplastic polymer onto the reinforcing fabric, for example by spraying or padding. The polymer film coating or laminate creates air tightness of the sheet material of the cushion member.

For example, the fabric is a high-strength fabric. Examples are fabrics made of fibers of glass, carbon, or polymer. Examples of useful fibers are made of Ultra High Molecular Weight Polyethylene, for example Dyneema®, High Molecular Weight Polyethylene, nylon (polyamide), such as ballistic nylon, Kevlar® (Aramid carbon), Tedlar® (polyvinyl fluoride), Vectran® (liquid crystal polymer), Spectra® (polyethylene), or Zylon® (liquid-crystalline polyoxazole). Such fabric is provided coated or laminated on one or both sides with a polymer material.

For example, the polymer layer on the outer side of the cushion member is made with a high friction layer in order to create stability when positioning it under an object and inflating it. If the outer layer is smooth and with low friction, it implies a risk for skidding away during inflation, which can lead to accidents. On the other hand, in some situations, a low-friction surface is useful and desired for sliding the cushion member, with or without object load, along a floor surface. Accordingly, in some embodiments, the cushion member comprises a first outer sheet layer on a first side and a second outer sheet layer on an opposite side, wherein the first outer sheet layer has a higher friction that the second outer sheet layer. In some embodiment, in order to increase the versatility, the air cushion member is provided with one high-friction side and an opposite low-friction side, the high-friction side having a substantially higher friction than the low-friction side.

For example, the cushion member is provided with a first sheet material in which a smooth fabric is only coated with an air tight polymer film layer on one side of the fabric, and the polymer film layer is facing inwards towards the air volume inside the cushion member, whereas the smooth fabric is facing outwards in order to yield a low friction surface on one side of the cushion member. Optionally, the second sheet material is provided with a likewise sheet, but the orientation of the sheet is such that the polymer film layer is on the outer side and the fabric layer in the inner side of the cushion member. Alternatively, the second sheet comprises a polymer film layer on the inner side as well as on the outer side of the cushion member. For example, the smooth fabric is a tightly woven, knitted, or compressed non-woven, polymer fabric, such as nylon or polyethylene fabric, or an ultra-high molecular weight polyethylene fabric. Examples for such low friction outer layers are high strength fabrics as exemplified above made of fibers of glass, carbon, or polymer When cushion members are provided with a high-friction surface on one or both sides, they are more safely stacked, as the tendency of the cushion members sliding relatively to each other is reduced. For example, two corrugated surfaces abutting each other will exhibit very high-friction, especially if the corrugations from the two surfaces are aligned. Likewise, two knobbed surfaces or otherwise roughened surfaces exhibit high-friction against each other, especially if made of rubber. Even a smooth low-friction surface against a high-friction surface may experience a high overall friction, for example if the high friction surface is made of rubber or other soft polymer, optionally silicone.

A Sleeve With Various Surface Features

In order to modify the surface features of cushion members, a sleeve is provided with a cavity, for example a single cavity, into which the cushion member can be inserted, typically only one cushion member, although there may also be provided sleeves for more than one cushion member, especially more than one cushion member in a single cavity of the sleeve.

The sleeve has two flexible sheets that are facing each other and which are secured to each other along the edge region, for example by welding, gluing and/or sewing, thereby forming a double layer edge region, however, leaving an opening for insertion of the cushion members into the sleeve, typically, in deflated condition. The sleeve has a size approximately equal to and only slightly larger than the deflated cushion member. For example, the sleeve is up to 2 cm or up to 5 cm larger than the flat side of the deflated cushion member.

In some embodiment, the sleeve is provided as a flexible but not readily stretchable sheet material, for example similar to the sheet material of the cushion material. The material is of a durable type configured to withstand the stress and tension when being used during lifting action of 50 kg or more without breaking. Optionally, the material is a fibre reinforced polymer material of the type as it was explained above for the cushion member. It is pointed out, however, that the sleeve need not be air tight in contrast to the cushion member. In other embodiments, the sleeve is resilient in order to allow increase in size, despite fitting snugly around the cushion member, be in inflated or deflated.

For example, the sleeve is provided with a high-friction surface on one or both sides or a low friction surface on one or both sides. Alternatively, the sleeve is provided with one high-friction surface on one side and a low-friction side on the opposite side. The various surface examples as given for the cushion members apply here equally well, including the above-mentioned knobbed or corrugated high-friction surfaces, and the low-friction surface with the reinforcing fabric facing outwards.

Accordingly, in some embodiments, the sleeve comprises a first outwards directed sheet layer on a first side and a second outwards directed sheet layer on an opposite side, wherein the first outer sheet layer has a higher friction than the second outer sheet layer.

Cushion members provided with a sleeve with at least one high-friction surface are safely stackable, as the high friction surface even when stacked in contact with a low-friction surface would provide high-friction between the two cushion members. For sleeves with one high-friction surface and one low friction surface, the orientation of the lowermost sleeve would determine whether the high or low friction side is towards the underlying support, for example the floor. Also, such type of sleeves can be stacked with other types of sleeves, for example sleeves that have a high-friction surface on both sides. The sleeves can be used in general for such inflatable cushion members and need not be used only in connection with stacking, although they are highly advantageous for stacking.

In order to have a plurality of options for modification of the surface features when using a cushion member, the sleeves are, optionally, provided as a set of sleeves with different surfaces. For example such set comprises at least one sleeve having high friction material, for example rubber, on one or both sides, and at least one sleeve having a low friction material on one or both sides. A sleeve with one low-friction side and one high-friction side is advantageously part of this set of sleeves.

A Pouch With Rigid Plates

Whereas, the cushion members and the above mentioned sleeves are flexible on the upper and lower sides, a different useful alternative has been found by providing a pouch as described in the following.

The pouch comprises two flat rigid plates that are mutually connected by an elastic belt, for example bellows-formed belt, along their circumference. The pouch has an opening for inserting one or more cushion members into a cavity inside the pouch. When the one or more cushion members are inserted into such cavity, inflation of the cushion will cause the two rigid plates to be pressed away from each other, which increases the distance between the two rigid plates. Such a system is especially useful for lifting or pressing apart objects with irregular surface. Whereas a cushion member would potentially adjust to the irregular surface or even get punctured and not perform the necessary lifting action, the rigid plates result in a stiff interface with well-defined distance over a relatively large surface, why such pouch improves the action of increased height adjustment as compared to a flexible cushion in case of irregular surfaces.

Typically, the sizes of the rigid plates are approximately equal to the size of the cushion member, potentially slightly larger, for example up to 2 cm or even up to 5 cm larger, in order to cover the cushion member when inserted into the pouch.

The surfaces of the rigid plates can be adapted to the various uses and may comprise a high-friction surface or a low friction surface or a combination thereof as also described above in connection with the surfaces of the cushion members or sleeves.

Accordingly, in some embodiments, the pouch comprises a first outwards directed sheet layer on a first side and a second outwards directed sheet layer on an opposite side, wherein the first outer sheet layer has a higher friction that the second outer sheet layer.

A Pouch With One Rigid Plate and a Flexible Sheet Material

A further alternative is found in the following. In this case, a pouch is provided with an opening and a cavity for insertion of the single cushion member or multiple cushion members through the opening into the cavity. The pouch is formed by one rigid plate with an edge region along which a flexible sheet material is fastened, extending from edge to edge across the width of the rigid plate so as to form a cavity between the rigid plate and the flexible sheet material. The at least one cushion member is provided inside the cavity of the pouch for by inflation of the cushion member causing the rigid plate and the flexible sheet to be pressed away from each other for increasing the distance between the rigid plate and the flexible sheet.

The flexible sheet is advantageously also resiliently stretchable in order to increase the volume of the cavity during inflation of the air cushion member inside the cavity.

Accordingly, in some embodiments, the pouch comprises a first outwards directed sheet layer on a first side, which is either on the rigid plate or the flexible side, and a second outwards directed sheet layer on an opposite side, wherein the first outer sheet layer has a higher friction that the second outer sheet layer.

Further Surface Features

Optionally, the air cushion member, or the sleeve or the pouch comprises at least one of the following: [0064] a fabric or Velcro® surface for easy sliding on a smooth support; [0065] a functional surface that that is heat resistant or fire retardant; [0066] elongate, protruding profiles, on the surface for mechanical stiffening; the elongate, protruding profiles potentially made of rubber, hard polymer or metal; [0067] a magnet or a functional magnetic surface for attachment to a magnetic or metallic surface; [0068] a suction cup for fastening to a smooth surface, [0069] a synthetic dry adhesive polymer for removable attachment to surfaces.

The elongate, protruding profiles also provide a frictional corrugated surface against skidding. Especially, such elongate, protruding profiles function as locking profiles so that edges of lifted elements, for example furniture, doors or windows during mounting or transport do not slide off the surface.

In some embodiments, the elongate, protruding profiles are an integral part of the surface, for example embedded in or part of the polymer that forms the surface.

For the elongate, protruding profiles, a large variety of shapes are possible. In some embodiments, they have a height that is less than twice the width. Alternatively, they are not higher than wide in order to provide a relatively flat but efficiently stabilizing profile. For example, the elongate, protruding profiles are straight, although, a curved shape is also applicable, for example in the shape of concentric circles or ellipses.

For example, one or more of such features are provided on [0074] one or both sides of the air cushion member; [0075] one or both sides of the sleeve; [0076] one or both rigid plates of the pouch with two opposite rigid plates; [0077] on the rigid plate or the flexible sheet or on both of the pouch with one rigid plate and a flexible sheet forming the cavity in combination.

Fixing Mechanism for Stacked Cushion Members or Stacked Sleeves

In order to improve height adjustment when using cushion members of the above type, a practical solution has been found in stacking at least two cushion members on top of each other, placing the stack underneath an object or between two objects, and inflating the cushion members and thereby lifting or generally moving the object.

In order for the plurality of cushion members to be fixed relatively to each other when stacked, in order to prevent one sliding down from the other, various fixation mechanisms can be used.

These fixation mechanisms can be applied to the cushion members themselves or they are applied to sleeves or pouches into which the cushion members are inserted. Such sleeve comprises two sleeve sheets that are facing each other and which are connected along the edge, however, leaving an opening for insertion of the cushion members into a cavity in the sleeve, typically, in deflated condition. The sleeve has a size approximately equal to and only slightly larger than the deflated cushion member. For example, the sleeve is up to 2 cm or even up to 5 cm larger than the flat side of the deflated cushion member. In some embodiment, the sleeve is provided as a flexible but not readily stretchable sheet material, for example similar to the sheet material of the cushion material. For example, the material is of a durable type configured to withstand the stress and tension when being used during lifting action of 50 kg or more. Optionally, the material is a fibre reinforced polymer material of the type as it was explained above for the cushion member. The various surface examples as given for the cushion members apply here equally well, including the above-mentioned knobbed or corrugated high-friction surfaces, and the low-friction surface, for example with the reinforcing fabric facing outwards. In other embodiments, the sleeve is resilient on order to snugly fit around an air cushion member irrespective of it being inflated or deflated.

The fixing mechanism is also applicable to the above-described pouches when stacked.

In some embodiments, the edge regions of the cushion members or the sleeves or the pouches comprise openings, for example holes or slots, through which binder strips or wires can be pulled and fastened. For example, such holes or slots are provided at the corners or the long edges where opposite sheets are fastened to each other. In practice, the user would stack a plurality of cushion members, one on top of the next, and pull fasteners, for example binder strips or wires, through these holes such that cushion members are stabilised with respect to their mutual position when inflated. Typically, the fasteners are attached prior to full inflation.

Advantageously, in addition to the use of fasteners, the cushion members or sleeves or pouches are provided with a high-friction surface on one or both sides, as described above. The cushion members are, then, not only stabilized in the stack by fasteners, but also secures against skidding by the surface material. The high-friction surface is either provided as part of the sheet material of the cushion or as part of the sleeve or pouch into which the cushion is inserted.

In other embodiments, retainer pads are provided between cushion members or sleeves or pouches for fixing adjacent sheet materials or rigid plates to each other during stacking by either pressing cooperating retainer pads together or by pressing a gluing retainer pad against the surface of a cushion member or sleeve. Once, the cushion members are stacked, or while the sleeves or pouches are stacked with cushion member inside the sleeves or pouches, the cushion members in the stack are inflated. For example, the inflation can be done by inflating one cushion member at a time, for example by separate pumps or by a common pump system with a single pump that is connected to a plurality of cushion members and, typically by valves, configured for sequential inflation of the cushion members.

An example of retainer pads comprises Velcro™ fasteners. Velcro™ fasteners are cooperating pairs of polymer sheets, one covered with tiny loops and the other with tiny flexible hooks, which adhere when pressed together and can be separated when pulled apart deliberately. In the present example, the one retainer pad with the tiny loops would be fixed, for example glued or welded, to the flat sheet of one inflatable cushion member or fixed, for example glued, welded or sewn, onto a sleeve or onto the rigid plate of a pouch and, one retainer pad with tiny flexible hooks would be fixed likewise to the flat sheet of another cushion member or sleeve or to another rigid plate of a pouch such that the two cushion members or sleeves or pouches would be removable attached to each other when positioning the two retainer pads against each other. More than two cushion members or sleeves or pouches can be fixed to each other in a stack of cushion members such that the total number of stacked cushions is more than two. Also, in a stack, cushion members, sleeves and pouches can be attached to each other in order to optimize a stack. For example, a pouch with a cushion member inside would form the base of a stack, followed by a cushion member directly on top of the pouch and followed on top of the stack by a sleeve with a cushion member inside.

As a further alternative, the retainer pads are fixed, for example glued, onto the sheet material or sleeve or pouch and are provided with a sticky surface such that they stick to each other during stacking. The sticky surface is optionally provided as a smooth surface of soft polymer. The effect during stacking is thus similar to the Velcro™ pads.

The use of retainer pads when stacking and the use of fastener through the holes or slits can be combined in order to achieve additional stability.

Height Adjustment Tool In order to improve the height adjustment when using a cushion member, a practical solution has been found when taking offset in the approach as disclosed in the aforementioned Danish patent DK177510B1, however, with the technical improvement of providing a support block that has an upper hollow in the form of a cavity into which the cushion members is laid down so that a part of the lower half of the cushion member is contained and supported when the cushion member is inflated. The hollow prevents the cushion member with or without sleeve to slide or roll away from the block, unintentionally. This makes the system safer than the prior art in Danish patent DK177510B1 by Dueholm, which was mentioned initially.

In some embodiments, the support block has an underside for placement on a supporting plane, for example a floor, and an upper side with the hollow. Optionally, the width and length of the support block is similar to the sheet dimensions of the cushion member, for example rectangular with a width and length of the support block in the range of 10-20 cm. The height of the support block is, typically, between 5 and 20 cm.

The hollow is less than half the thickness of an inflated cushion member, for example 1-3 cm deep.

In case that the support block is desired secured against the underlying support, for example floor, the underside, which is the side opposite to the hollow, is optionally provide with a high-friction surface, for example soft-polymer or rubber surface, or a rough, knobbed or corrugated surface. Alternatively, a low-friction surface is provided on its underside for easy sliding on a smooth support or on carpets. Examples of low friction surfaces are fabrics against smooth substrates, especially high-strength fabrics as mentioned above or Velcro® surfaces. For example, as alternatives, the low friction surface comprises a polished polymer surface, potentially nylon, or optionally Teflon. In some embodiments, the block comprises an underside having a different friction coefficient than the cushion member.

The support block can be used in connection with a stack of cushion members, for example including sleeves or pouches, which are stacked on top of the support block.

Optionally, in order to adjust the height, one or several extension plates are provided for placement under the support block. The number of the extension plates is freely selectable in order to adjust the total height to a suitable level. Advantageously, the support plates, and optionally also the support block, are provided with a high-friction surface or alternatively with cooperating protrusions and indentations such that a mutual skidding among the plurality of support plates is prevented.

For example, the lowest of the extension plates has a low-friction surface on its underside for easy sliding on a smooth support or on carpets, similarly as explained above for the support block. Examples of low friction surfaces are fabrics against smooth substrates, especially high-strength fabrics as mentioned above or Velcro® surfaces. For example, as alternatives, the low friction surface comprises a polished polymer surface, potentially nylon, or optionally Teflon.

Typically, the extension plates would be rigid, for example solid. However, height-adjustable extension plates, for example by inflation, are also possible.

Optionally, the support block comprises wheels, for example swivel wheels, for ease of maneuvering on a support surface, such as a floor. As alternatives, ball rollers or continuous tracks on rollers, optionally the track having soft lamella, are used. Optionally, the wheels, ball rollers or tracks are driven by an electrical motor, for example remote controlled, wirelessly or by a wired connection.

Common Air Pump

In stacked conditions, the cushion members are optionally each connected via the hose connection to one air pump, for example a manually operated balloon or an electrical pump. Alternatively, multiple cushion members are connected through the hose-connection to a common air pump in order to inflate multiple cushion members simultaneously during pumping, although, it is also possible to include a valve system inflating one cushion member after the other. In some embodiments, the inflation tool additionally comprises a valve arrangement for deflating the air cushion members. Alternatively, valves for deflation are provided remotely from the inflation tool, for example near the air cushion members or on the hose that connects the air cushion members with the inflation tool. An example is a valve arrangement near the inflation tool.

For special applications, where sequential inflation and/or deflation is required, for example for various combinations of sequential lifting and lowering, this is achieved by providing a corresponding regulator in the inflation tool or external to the inflation tool. The regulator is configured for manual adjustment by a keypad or by knobs. Alternatively, the regulator is connected to an electronic controller that comprises programs or is programmable for special sequences of inflation and deflation of air cushion members or group of air cushion members one after the other or in common. In some embodiments, the controller is also connected to an electrical common air pump, such as a compressor, in order to start and stop the common air pump when not used for inflation during the sequential inflation and deflation and before and after such sequence.

In a simple version, the inflation is done with a hand operated squeeze balloon or foot operated bellows and with manually operated valves for inflation and deflation. In more advanced forms, the device comprises an electrically, hydraulically or pneumatically driven common air pump, which is controlled by a programmable electronic controller, functionally connected to the common air pump and to a regulator for regulation of inflation and deflation of the hose-connected air cushion members or groups of air cushion members. However, it is also possible to use manually operated valves and an electrical driven compressor. Thus, various mixes of parts of the described embodiments is also possible. The device has a large versatility and flexibility in adjustment to the actual use.

In a further embodiment, the inflation tool is configured for selective shift between a first inflation mode and a second inflation mode by the common air pump; wherein the first mode is inflation of the first and second cushion member simultaneously and the second mode is inflation of the first and second cushion member sequentially one after the other. This principle is correspondingly extendable to more than two cushion members.

In some embodiments, the device comprises a regulator, optionally as part of the inflation tool, the regulator having an air inlet, which is connected to the common pump, and a first and a second air outlet, the first air outlet being connected to the first air cushion member or to a first group of air cushion members and the second outlet being connected to the second air cushion member or to a second group of air cushion members. The regulator is adjustable to selectively inflate one or the other of the first and second air cushion member or group of air cushion members at a time.

Use of the Device The device according to the invention is suitable for lifting and adjusting a variety of elements, for example machines, frames, doors, windows, walls, and furniture, for example tables or kitchen elements. The air cushion members are placed between the element and the support and can be used for a vertical lift or for non-vertical horizontal adjustment or both. For example, on air cushion member is placed under each corner of the element or under each leg of a table. In the foregoing, examples have been given in relation to lifting and lowering, however, the examples apply equally well for non-vertical movements, for example sideways movements.

In more general terms, a method is provided for moving an object over a support, wherein the object is resting on the support by gravity and has points of contact with the support. The device is selected with a surface, typically underside, of the device which has a friction against the support which is lower than the friction of the object's points of contact on the support. The low friction surface is oriented against the support and positioning the device under the object so that by inflation of the cushion member the height of the device is extended, which leads to lifting the object off the support. Once lifted, the object is moved along the support, for example while the surface is sliding on the support or, in case of a wheeled support is used, by rolling the device on the support. Typically, the support is a floor, however, it could also be a lifted platform of another type.

SHORT DESCRIPTION OF THE DRAWINGS

The invention will be explained in more detail with reference to the drawing, where FIG. 1 illustrates a prior art air cushion member to be employed is a system according to the invention, where FIG. 1A is a perspective drawing, and FIG. 1B illustrates three situations, non-inflated, normal inflated, high pressure inflated;

Figure 7A:
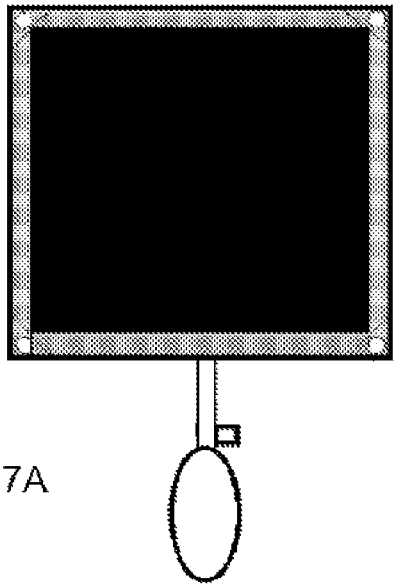
Figure 7B:
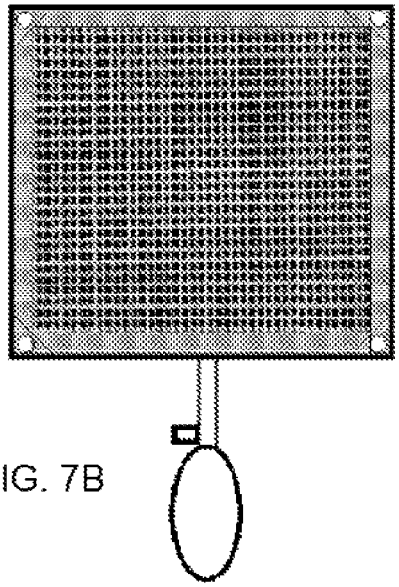
Figure 7C:
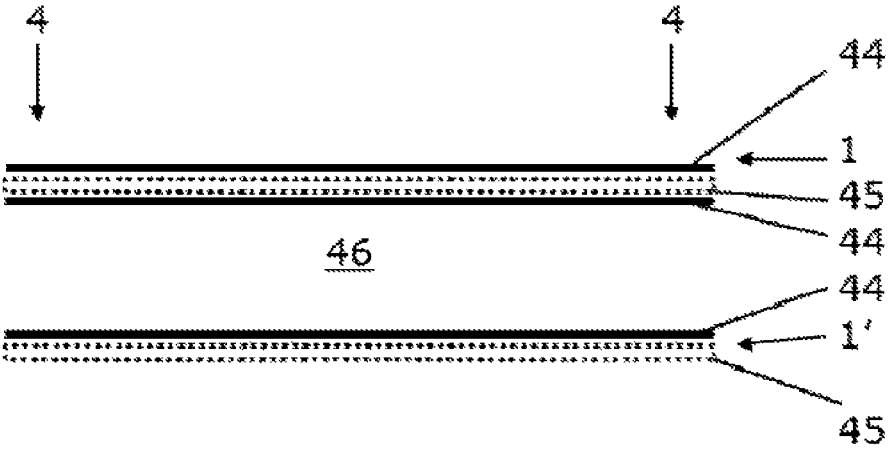
Figure 8A:
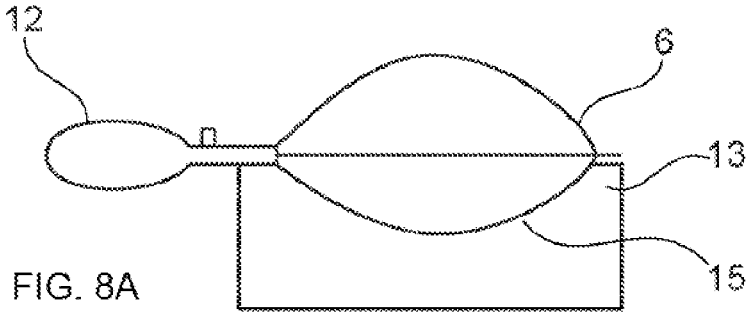
Figure 8B:
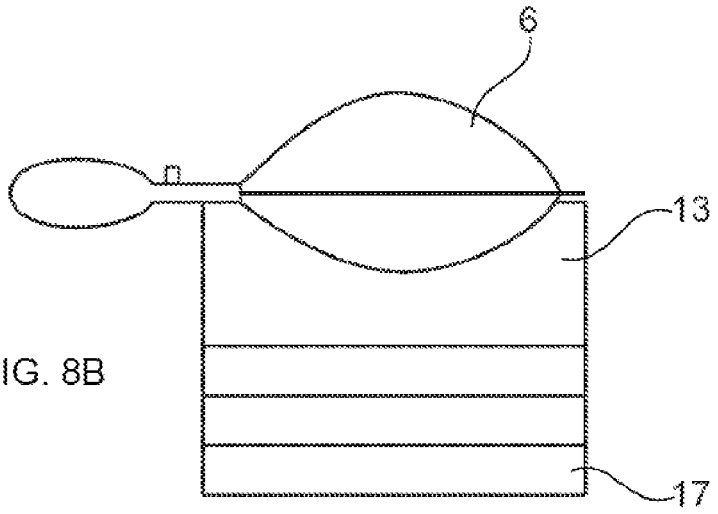
Figure 8C:
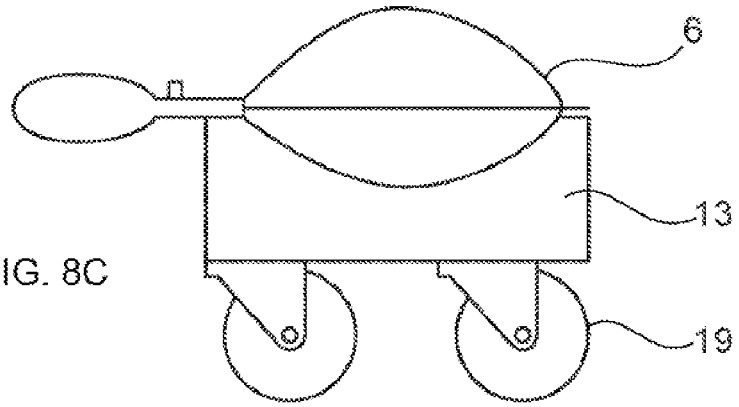
Figure 8D:
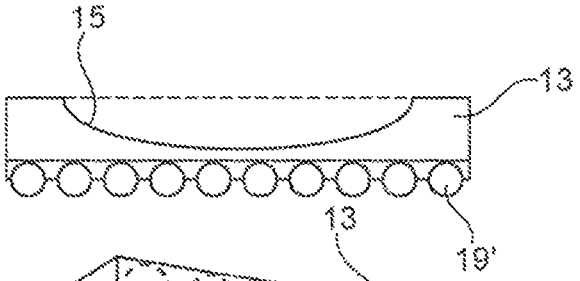
Figure 8E:
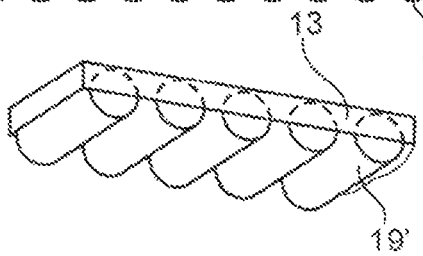
Figure 8F:
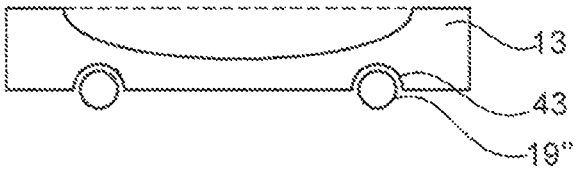
Figure 8G:
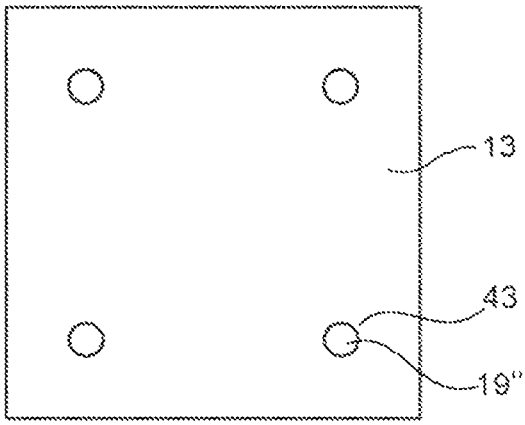
Figure 8H:
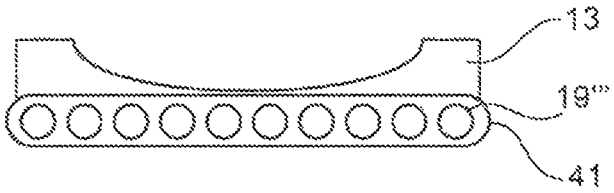
Figure 8I:
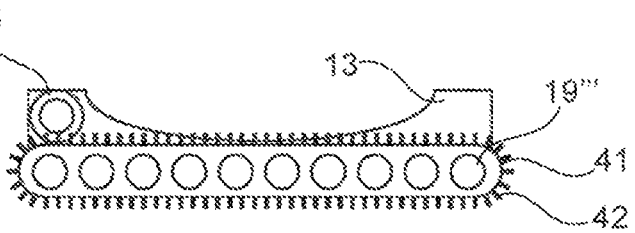
Figure 8J:
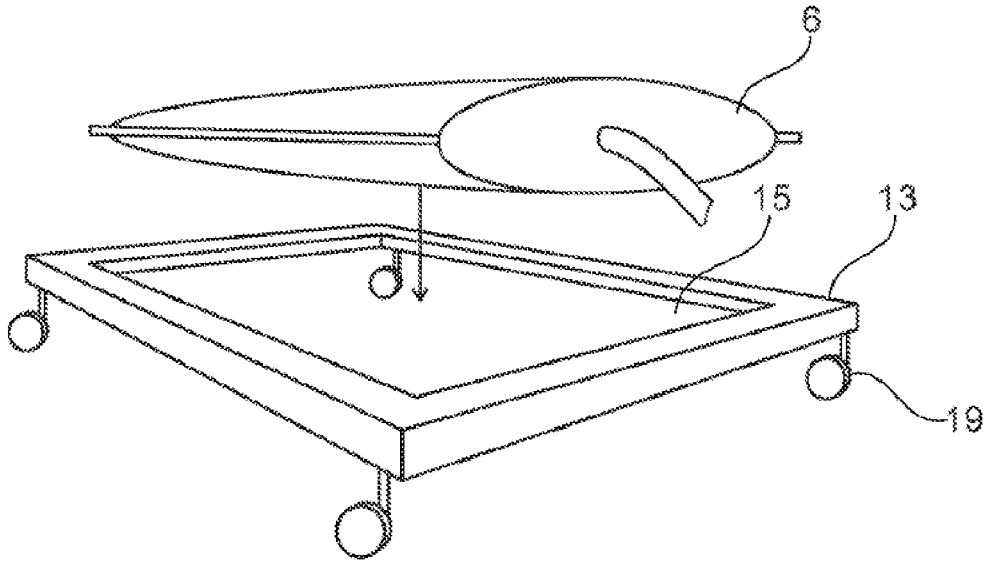
Figure 9A:
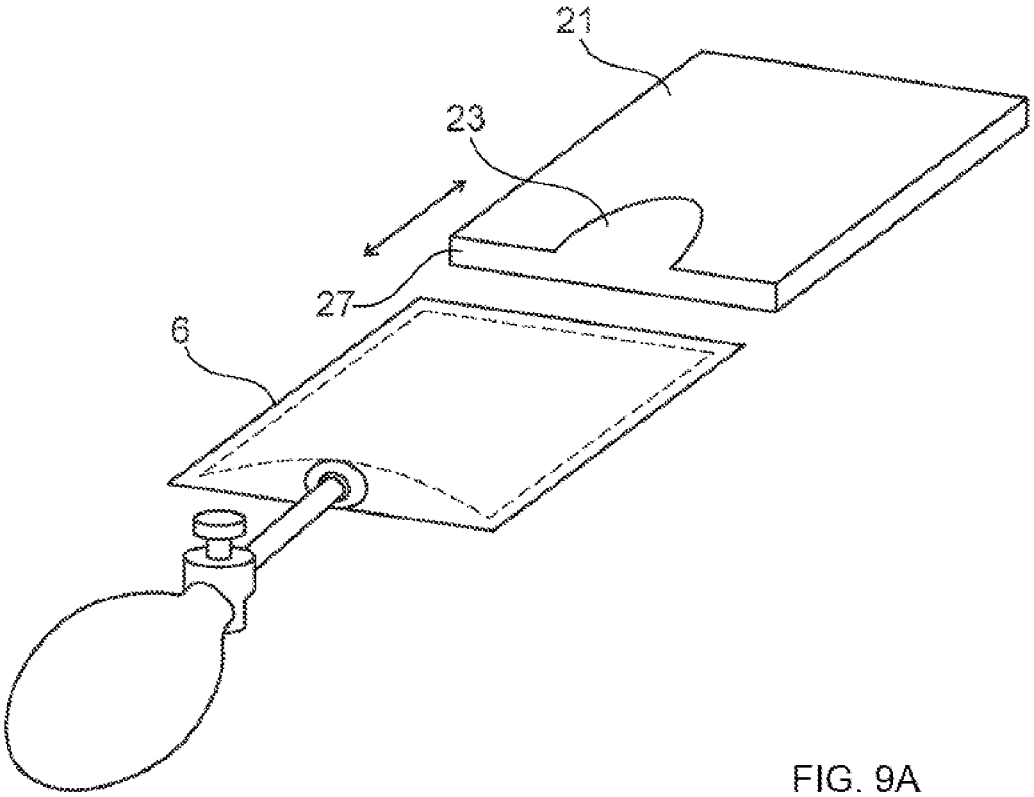
Figure 9B:
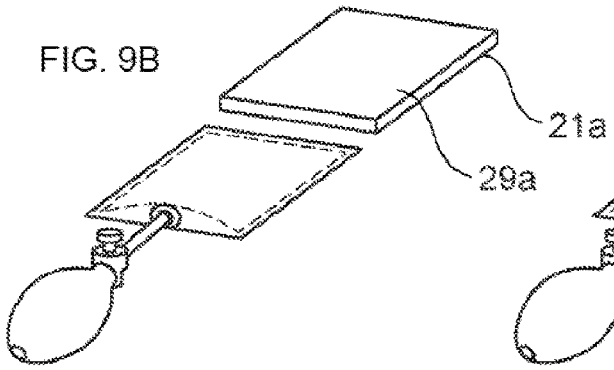
Figure 9C:
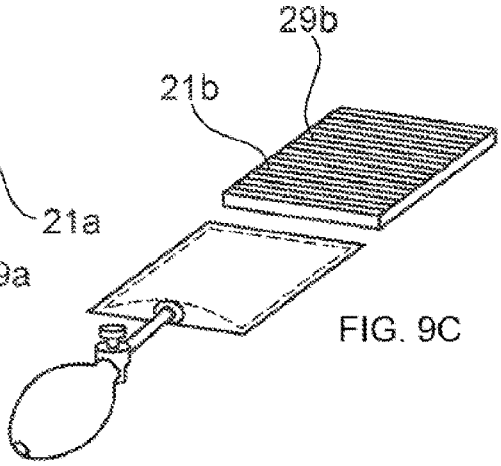
Figure 9D:
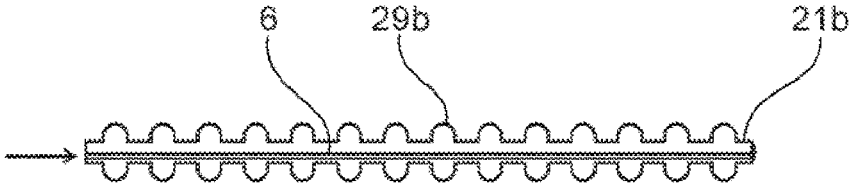
Figure 9E:
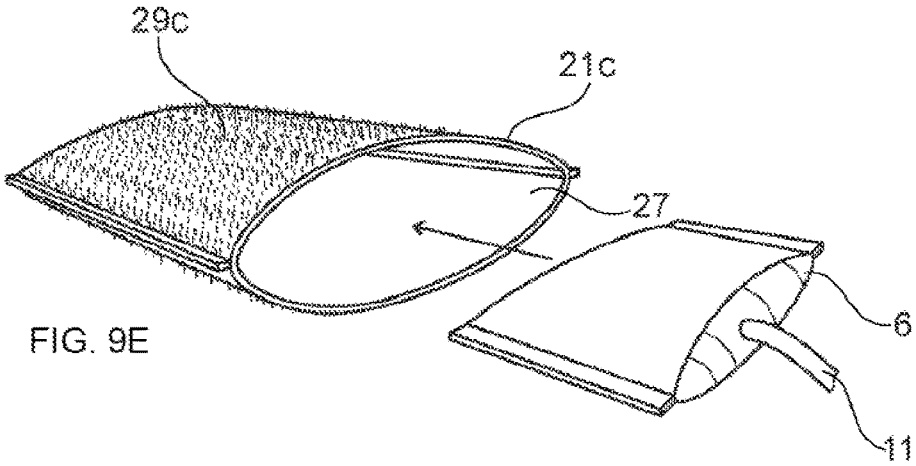
Figure 9F:
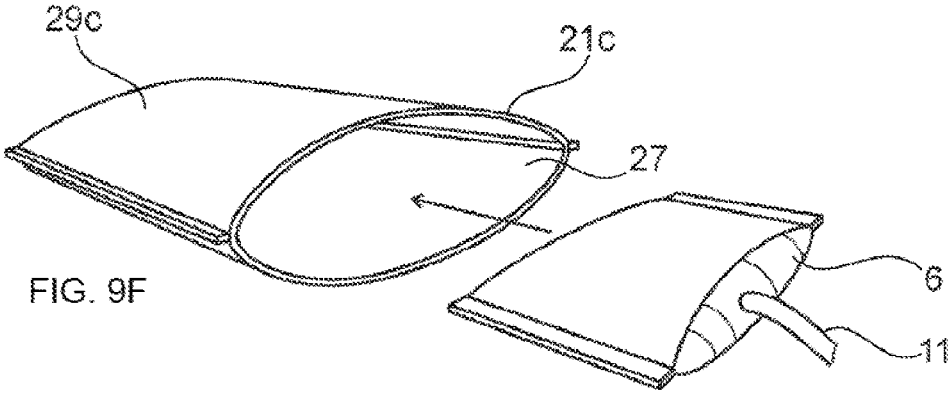
Figure 9G:
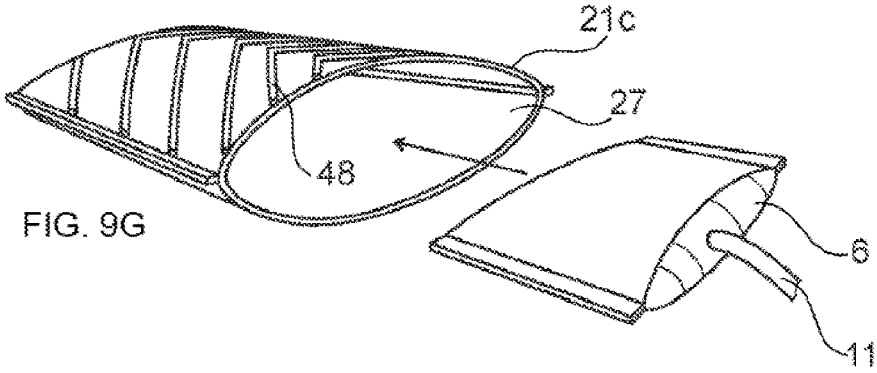
Figure 9H:
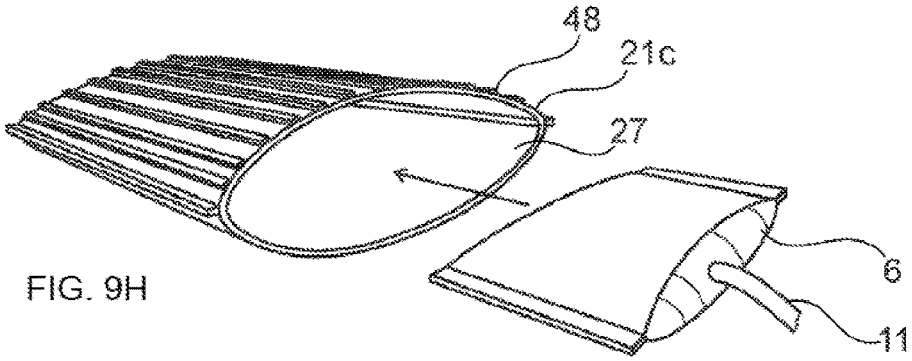
Figure 9I:
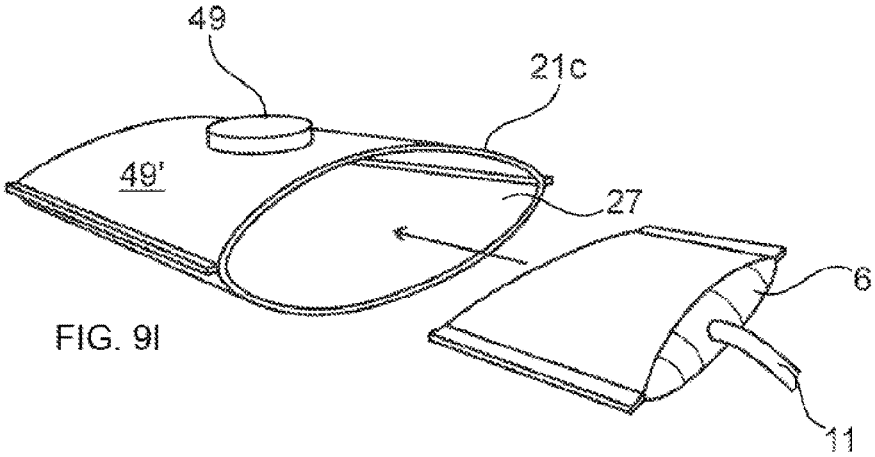
Figure 9J:
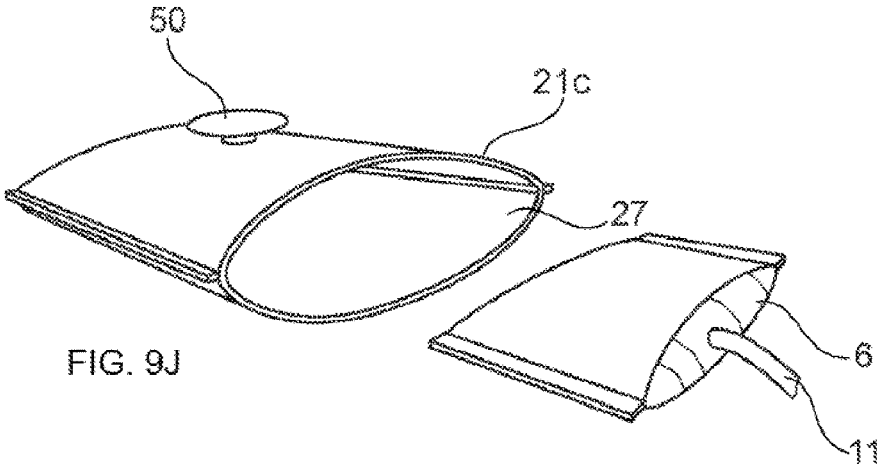
Figure 9K:
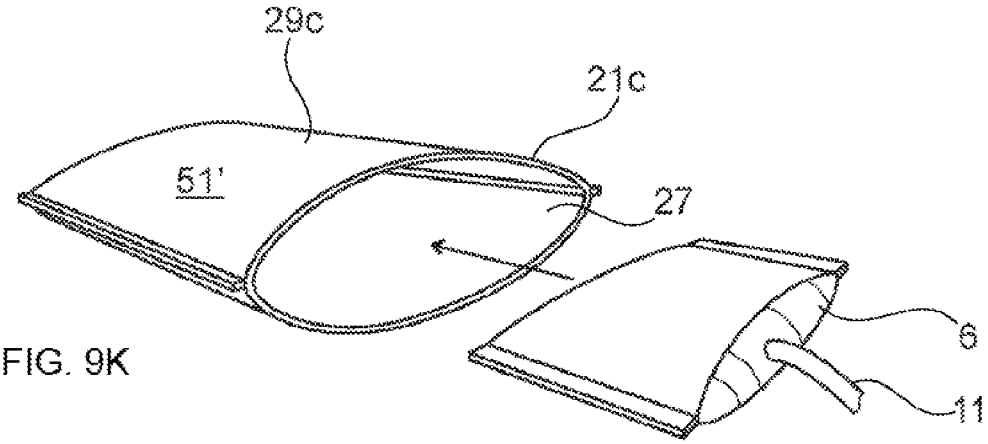
Figure 10A:
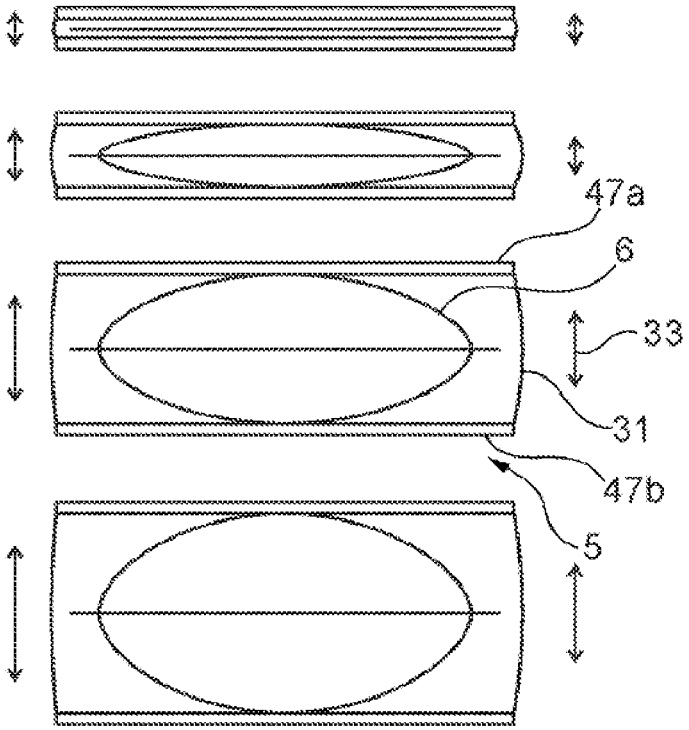
Figure 10B:
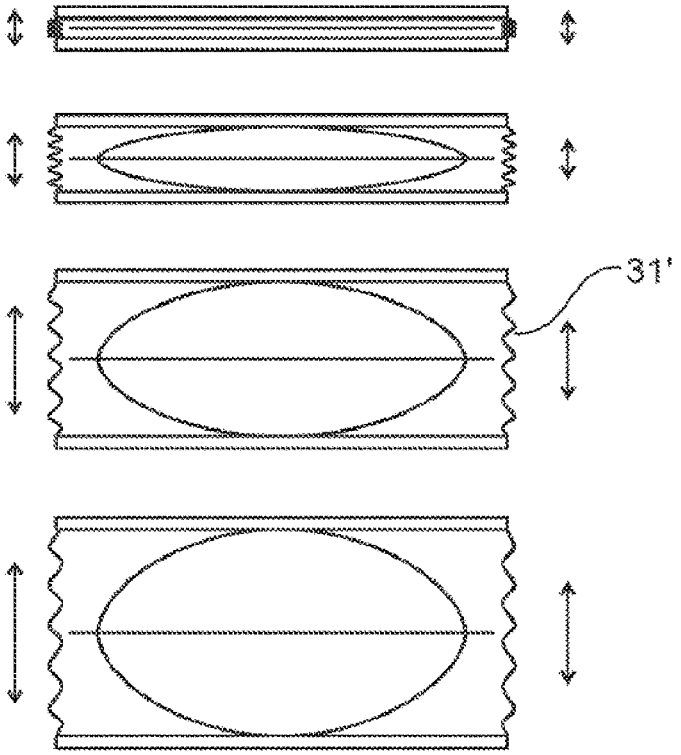
Figure 10C:
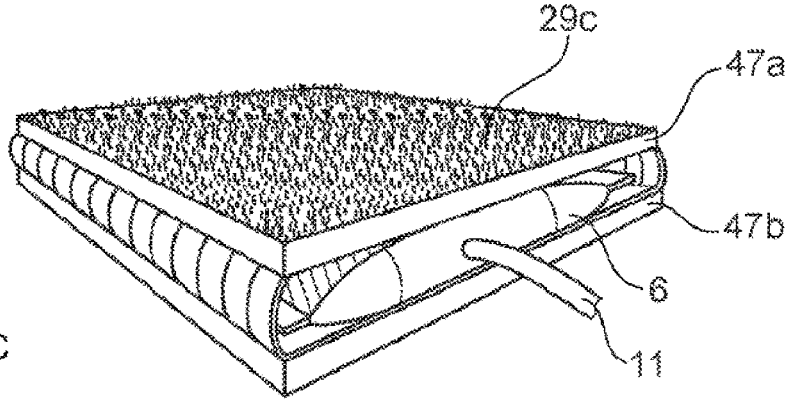
Figure 10D:
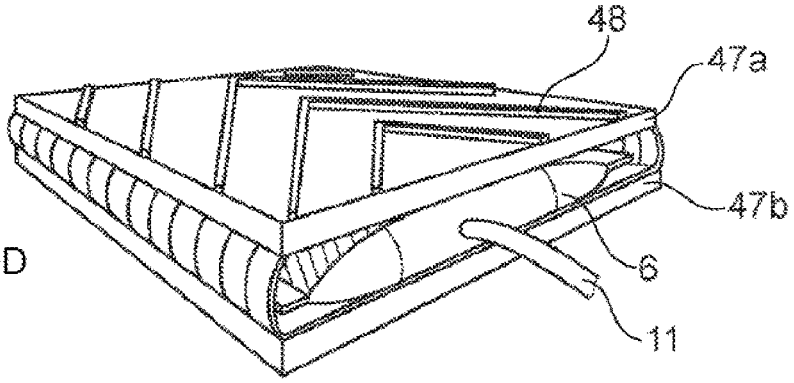
Figure 10E:
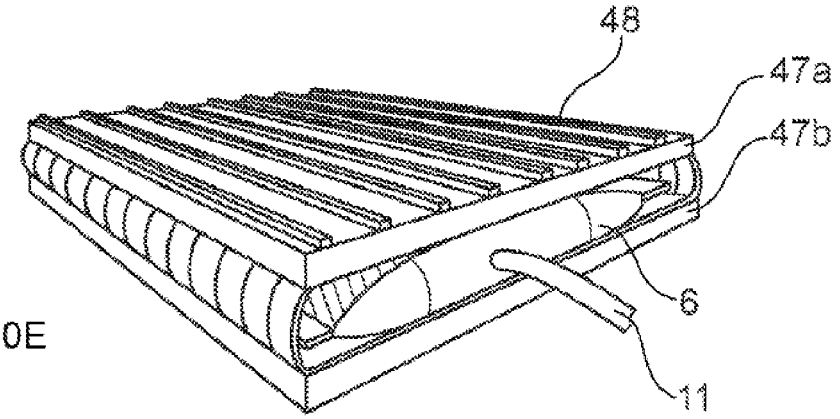
Figure 10F:
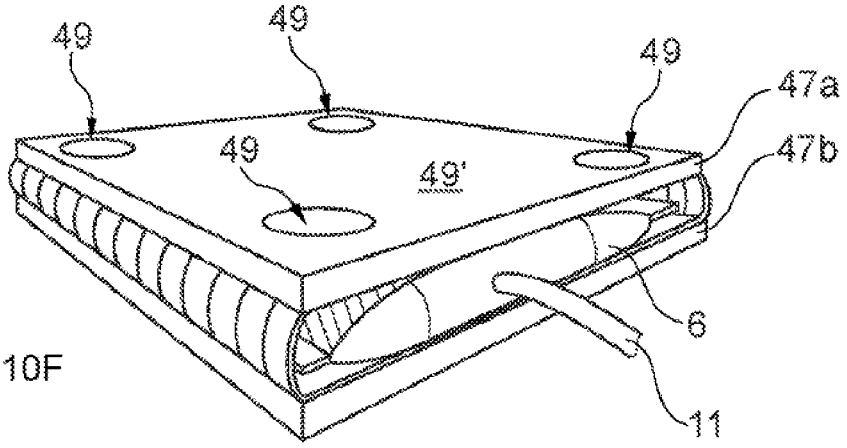
Figure 10G:
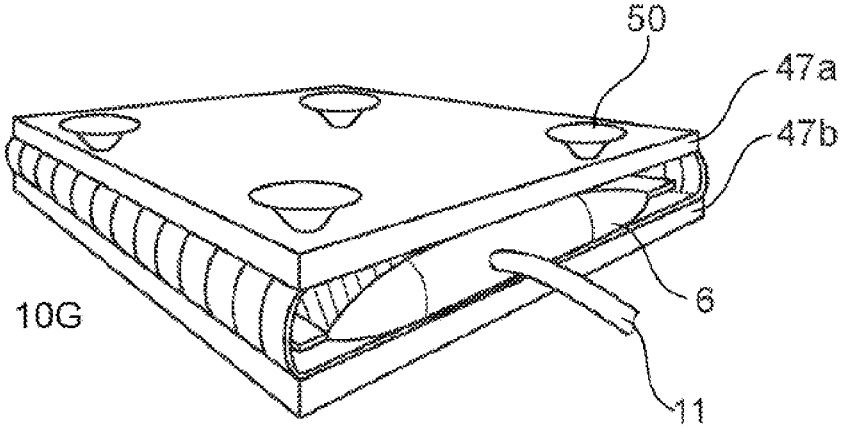
Figure 10H:
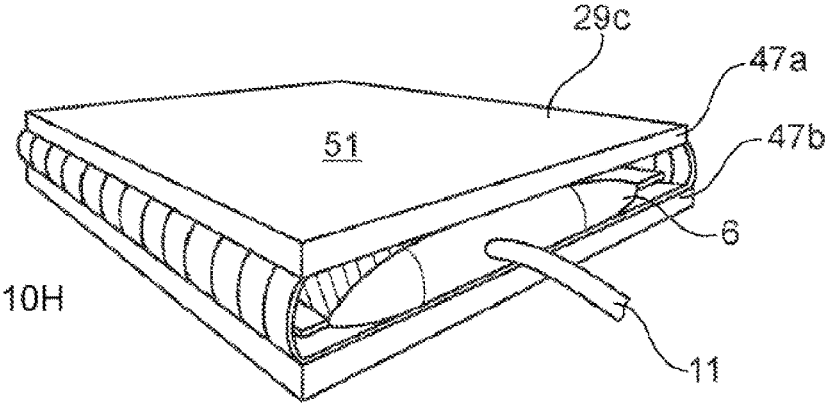
Figure 10I:
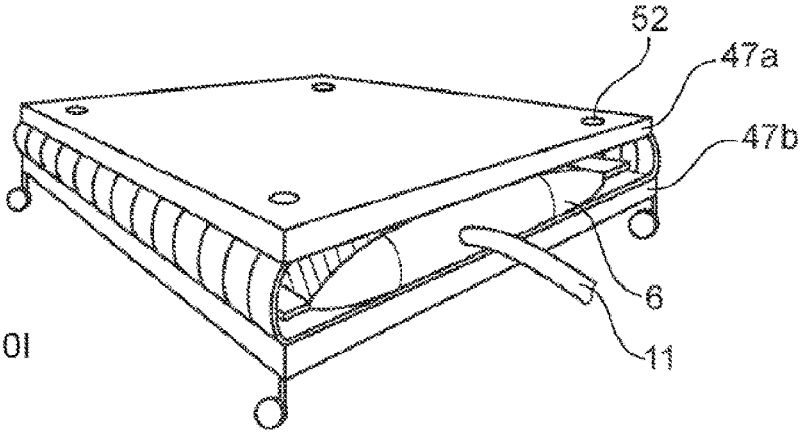
Figure 11A:
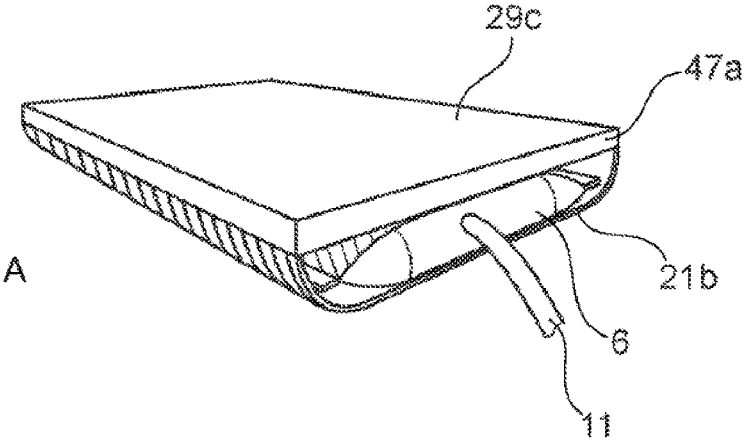
Figure 11B:
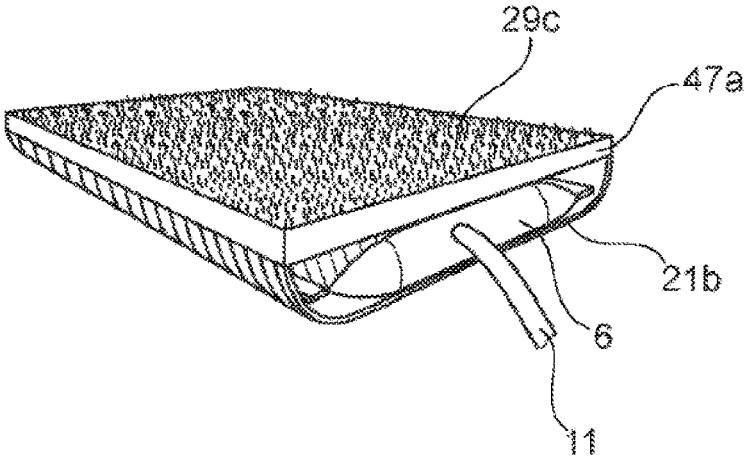
Figure 11C:
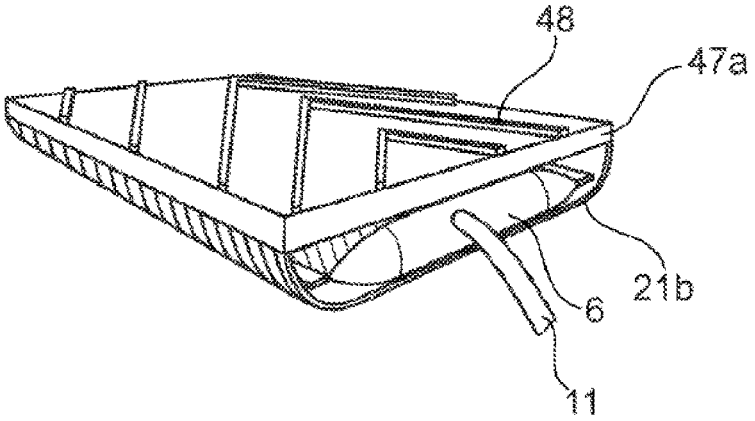
Figure 11D:
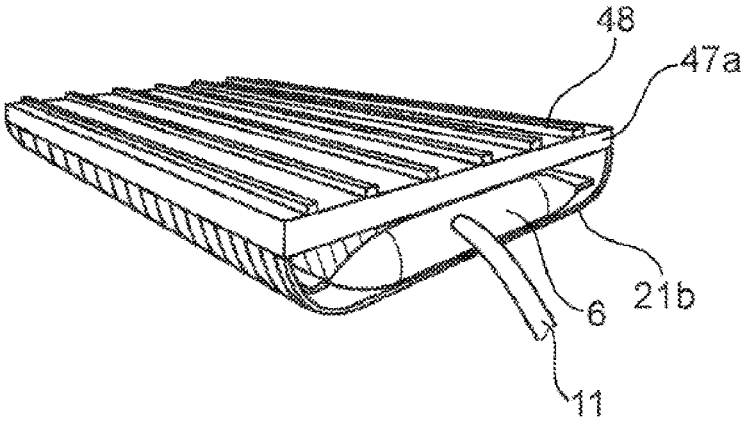
Figure 11E:
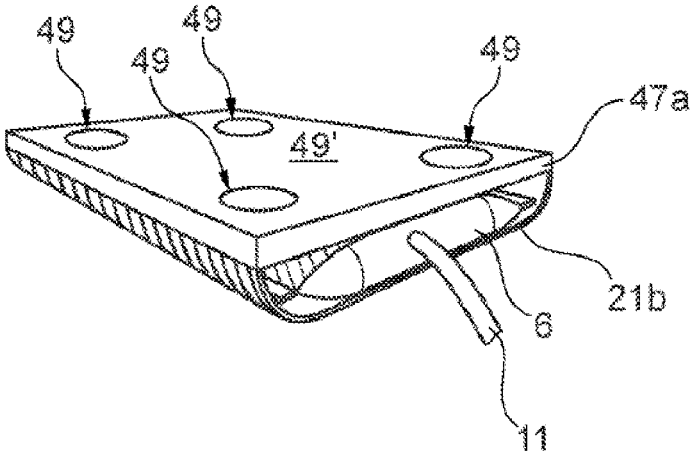
Figure 11F:
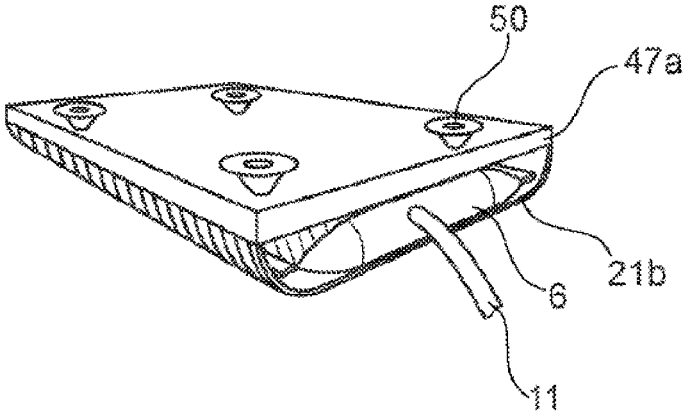
Figure 11G:
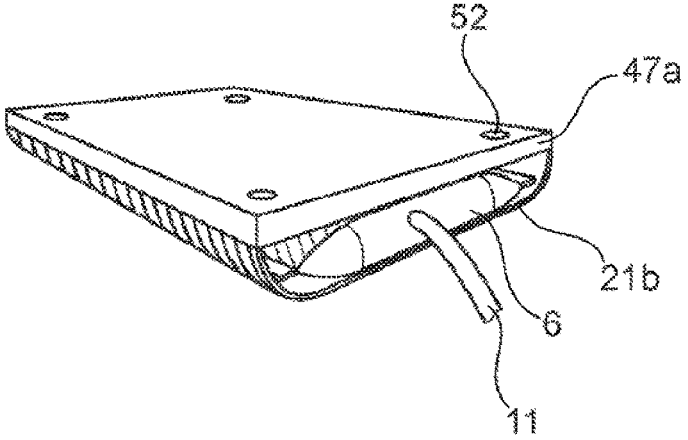
Figure 12A:
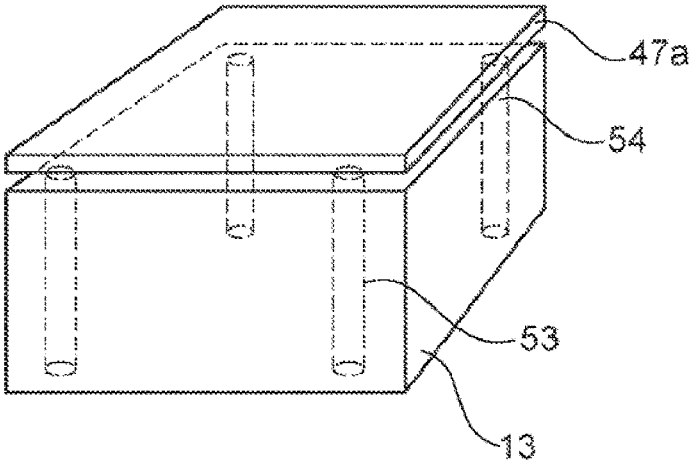
Figure 12B:
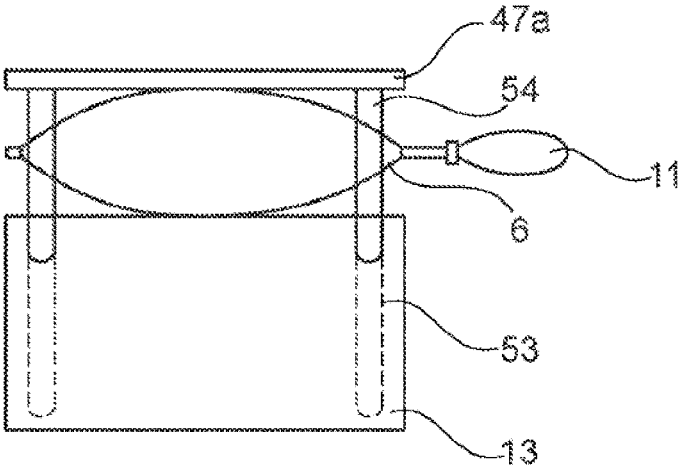
Figure 12C:
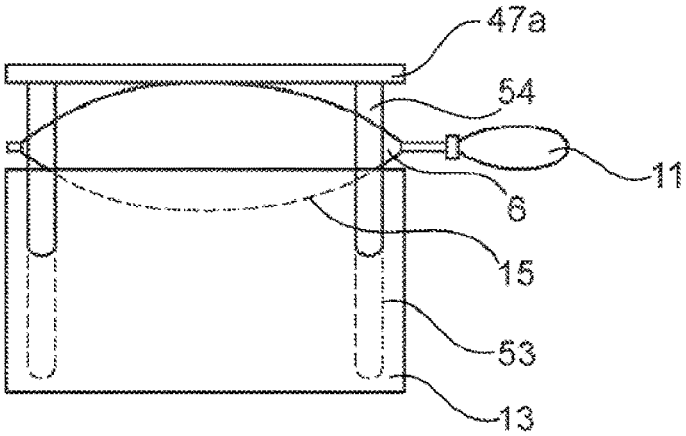
Figure 12D:
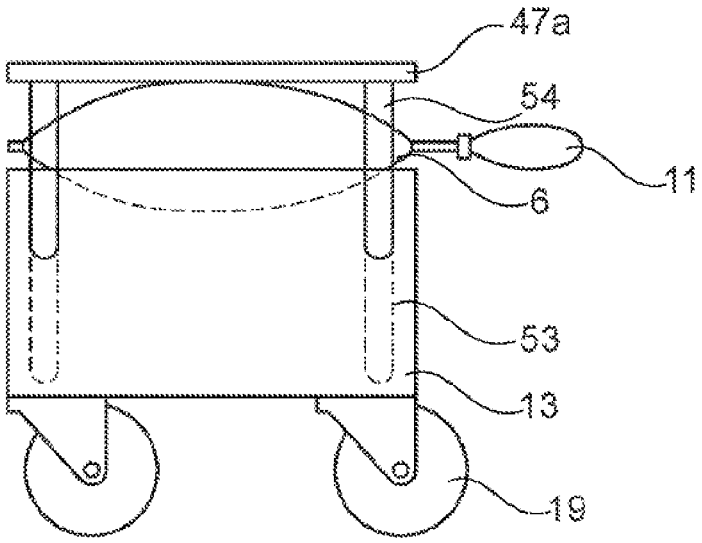
Figure 12E:
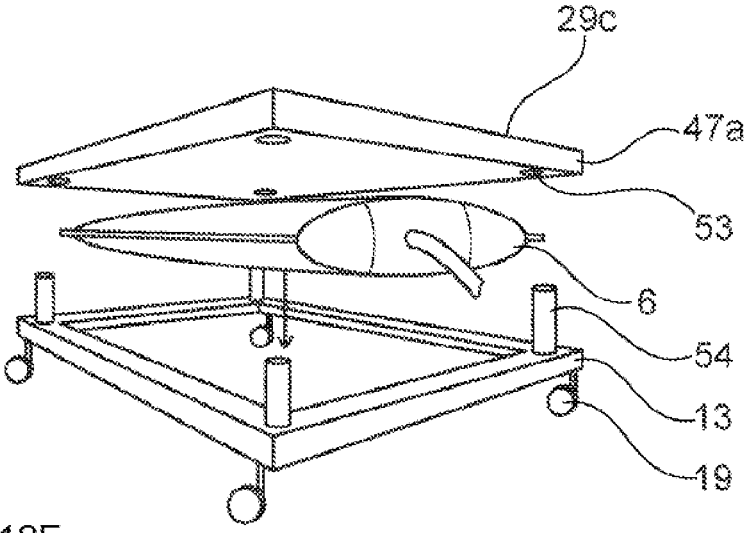
Figure 13:
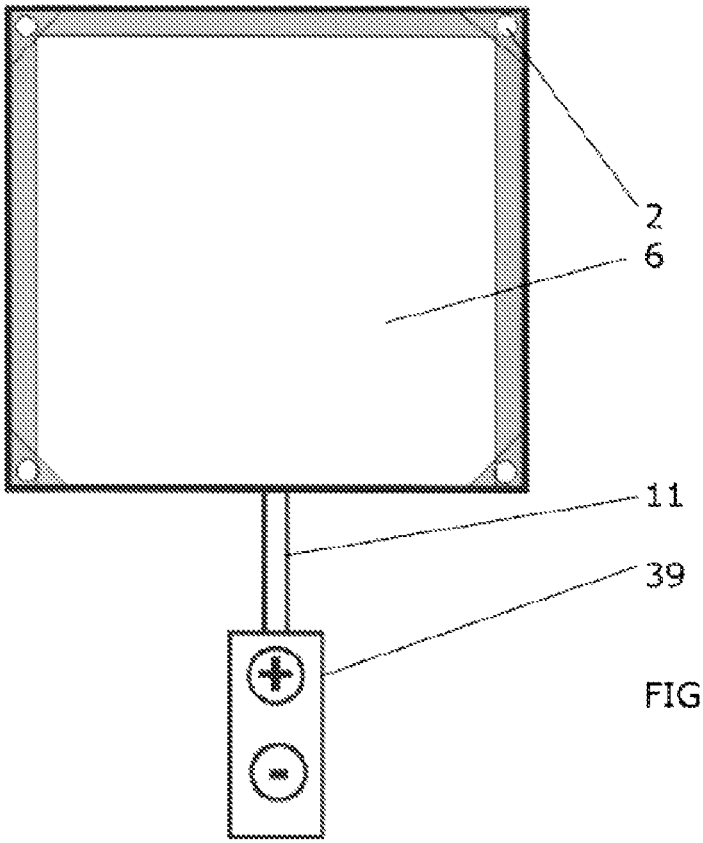

FIG. 6A illustrates an embodiment of cushion members with Velcro™ tabs for safe stacking; FIG. 6B illustrates a stack of such cushion members in end view; FIG. 6C illustrates a stack of such cushion members in side view moderately inflated; FIG. 6D illustrates a stack of such cushion members in side view fully inflated;

FIG. 7A illustrates a cushion member with a high friction surface on one side; FIG. 7B illustrates a cushion member with a low friction surface on one side; FIG. 7C is a cross sectional principle sketch;

FIG. 8A illustrates an air cushion member on a support block; FIG. 8B illustrates an air cushion member with height adjusting support plates; FIG. 8C illustrates an air cushion member with wheels, FIG. 8D illustrates an air cushion member with cylindrical rollers in side view; FIG. 8E illustrates an air cushion member with cylindrical rollers in perspective bottom view; FIG. 8F illustrates an air cushion member with ball rollers in side view; FIG. 8G illustrates an air cushion member with ball rollers in bottom view; FIG. 8H illustrates an air cushion member with a continuous track on rollers; FIG. 8I illustrates an air cushion member with a continuous track on rollers, the track having soft lamella, FIG. 8J illustrates an air cushion member a support block with rollers and a flat hollow for the air cushion member;

FIG. 9A illustrates a cushion member with a sleeve, where the sleeve is shown a) with a cut-out; FIG. 9B illustrates a cushion member with a sleeve, where the sleeve is shown with a smooth surface; FIG. 9C illustrates a cushion member with a sleeve, where the sleeve is shown with a corrugated surface; FIG. 9D illustrates a cushion member with a sleeve, where the sleeve is shown in enlarged view with a corrugated surface (not to scale); FIG. 9E illustrates a cushion member with a sleeve, where the sleeve is shown with a fabric or Velcro® surface for easy sliding on a smooth support; FIG. 9F illustrates a cushion member with a sleeve, where the sleeve is shown with a functional surface that is heat resistant and/or fire retardant; FIG. 9G illustrates a cushion member with a sleeve, where the sleeve is shown with diagonal elongate, protruding profiles; FIG. 9H illustrates a cushion member with a sleeve, where the sleeve is shown with elongate, protruding profiles in longitudinal direction; FIG. 9I illustrates a cushion member with a sleeve, where the sleeve is shown with a surface comprising a magnet or with a functional magnetic surface; FIG. 9J illustrates a cushion member with a sleeve, where the sleeve is shown with a suction cup; FIG. 9K illustrates a cushion member with a sleeve, where the sleeve is shown with a functional surface comprising a synthetic dry adhesive;

FIG. 10A illustrates a cushion member inside a pouch with two rigid plates connected by an elastic belt along the periphery, where the pouch along its circumference comprises a resiliently elastic belt; FIG. 10B illustrates a cushion member inside a pouch with two rigid plates connected by an elastic belt along the periphery, where the pouch along its circumference comprises elastic bellows; FIG. 10C illustrates a cushion member inside a pouch with two rigid plates connected by an elastic belt along the periphery, where the pouch along its circumference comprises a plate comprising a fabric or Velcro™ surface for easy sliding on a smooth support; FIG. 10D illustrates a cushion member inside a pouch with two rigid plates connected by an elastic belt along the periphery, where the pouch along its circumference comprises diagonal elongate, protruding profiles; FIG. 10E illustrates a cushion member inside a pouch with two rigid plates connected by an elastic belt along the periphery, where the pouch along its circumference comprises elongate, protruding profiles in longitudinal direction; FIG. 10F illustrates a cushion member inside a pouch with two rigid plates connected by an elastic belt along the periphery, where the pouch along its circumference comprises a surface comprising magnets or with a functional magnetic surface; FIG. 10G illustrates a cushion member inside a pouch with two rigid plates connected by an elastic belt along the periphery, where the pouch along its circumference comprises suction cups; FIG. 10H illustrates a cushion member inside a pouch with two rigid plates connected by an elastic belt along the periphery, where the pouch along its circumference comprises a functional surface comprising a synthetic dry adhesive; FIG. 10I illustrates a cushion member inside a pouch with two rigid plates connected by an elastic belt along the periphery, where the pouch along its circumference comprises indentations for ease of stacking when used in combination with cooperating pins;

FIG. 11A illustrates a pouch with only one rigid plate and an opposite flexible sleeve side, where the rigid plate has a functional surface; FIG. 11B illustrates a pouch with only one rigid plate and an opposite flexible sleeve side, where the functional surface comprises a fabric or Velcro™ layer for easy sliding on a smooth support; FIG. 11C illustrates a pouch with only one rigid plate and an opposite flexible sleeve side, with diagonal elongate, protruding profiles; FIG. 11D illustrates a pouch with only one rigid plate and an opposite flexible sleeve side, with elongate, protruding profiles in longitudinal direction; FIG. 11E illustrates a pouch with only one rigid plate and an opposite flexible sleeve side, with a surface comprising magnets or with a functional magnetic surface; FIG. 11F illustrates a pouch with only one rigid plate and an opposite flexible sleeve side, with suction cups; FIG. 11G illustrates a pouch with only one rigid plate and an opposite flexible sleeve side, with a with indentations for ease of stacking;

FIG. 12A shows a support block with a rigid plate guided by cooperating guiding pins and holes, illustrating the collapsed state; FIG. 12B shows a support block with a rigid plate guided by cooperating guiding pins and holes, illustrating the state where an air cushion is inserted; FIG. 12C shows a support block with a rigid plate guided by cooperating guiding pins and holes, illustrating an alternative embodiment with a hollow for securing the sleeve; FIG. 12D shows a support block with a rigid plate guided by cooperating guiding pins and holes, illustrating an embodiment comprising wheels; FIG. 12E shows a support block with a rigid plate guided by cooperating guiding pins and holes, illustrating a flat version with a hollow;

FIG. 13 illustrates a cushion member with a small battery driven pump.

DETAILED DESCRIPTION/PREFERRED EMBODIMENT

In the following, identical elements or corresponding elements are carrying the same signs of reference, and no repeated descriptive explanation is given below for each single element within the different figures which belong to the drawing.

Figure 1A:
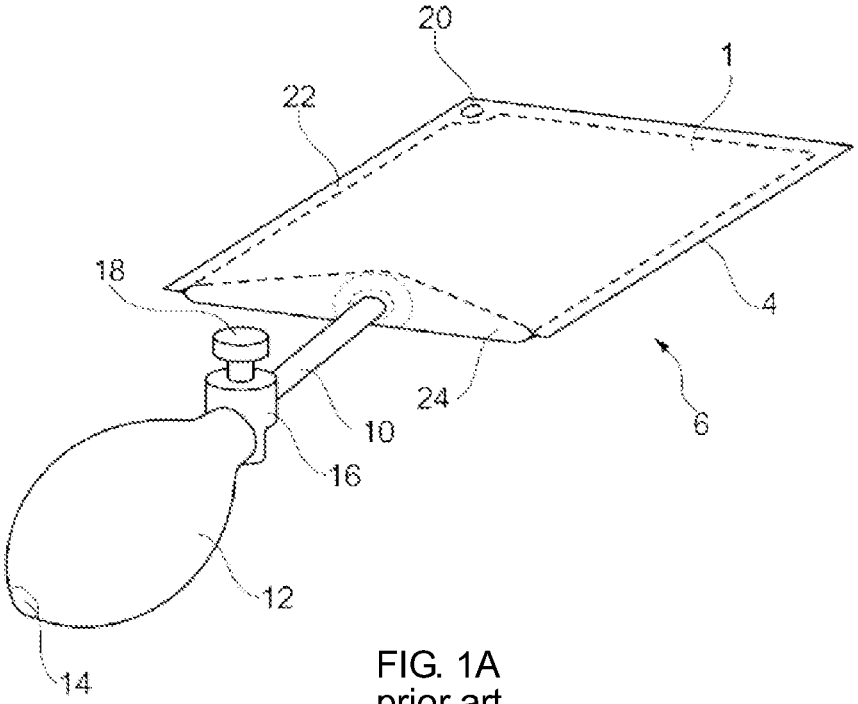
FIG. 1A prior art

FIG. 1*a* illustrates a prior art inflatable air cushion member 6 that is also useful as part of the system as described herein, especially when modified as compared to the prior art cushion members. As illustrates in FIG. 1*a*, the cushion member 6 is a flat bag unit with two layers of a tough and flexible but not readily stretchable material placed face to face and joined along an edge region 4, for example by a welding 22, optionally ultrasonic welding. In the shown embodiment, the air cushion member 6 comprises a folded rectangular piece of a sheet material 1 such that a fold 24 constitutes one edge of the rectangle and the remaining edge region 4 constitutes three other edges of the rectangle. At the fold 24, there is provided a foot piece of an outwardly protruding bendable connector piece 10 for connection to an inflation balloon 12 comprising an intake valve 14. The balloon 12 is manually operated by squeezing of the balloon 12 by hand, which causes the intake valve to close. At the balloon 12, a deflation valve 16 is provided with an actuator button 18 for deflation of the cushion member. At a corner portion of the edge region 4 a hole 20 is provided. The connector piece 10 may, optionally, protrude while forming an acute angle with the folding edge at 24, so that the balloon 12 is inclined relatively to the air cushion member 6.

Figure 1B:
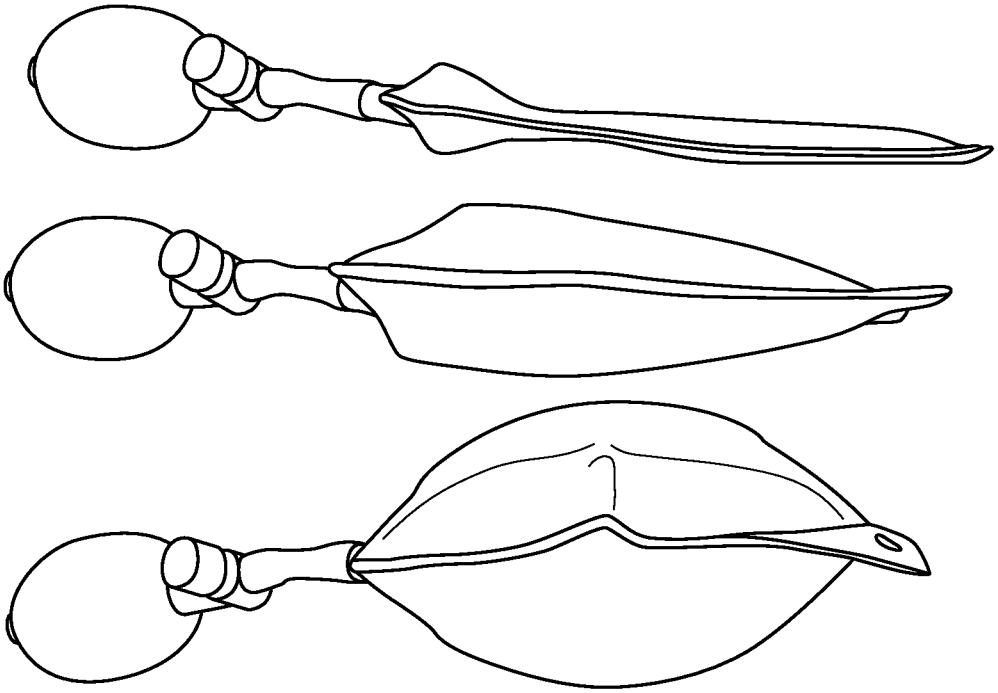
FIG. 1B prior art

FIG. 1B shows three inflation situations of a corresponding product, non-inflated, normally inflated and high pressure inflate.

Figure 2:
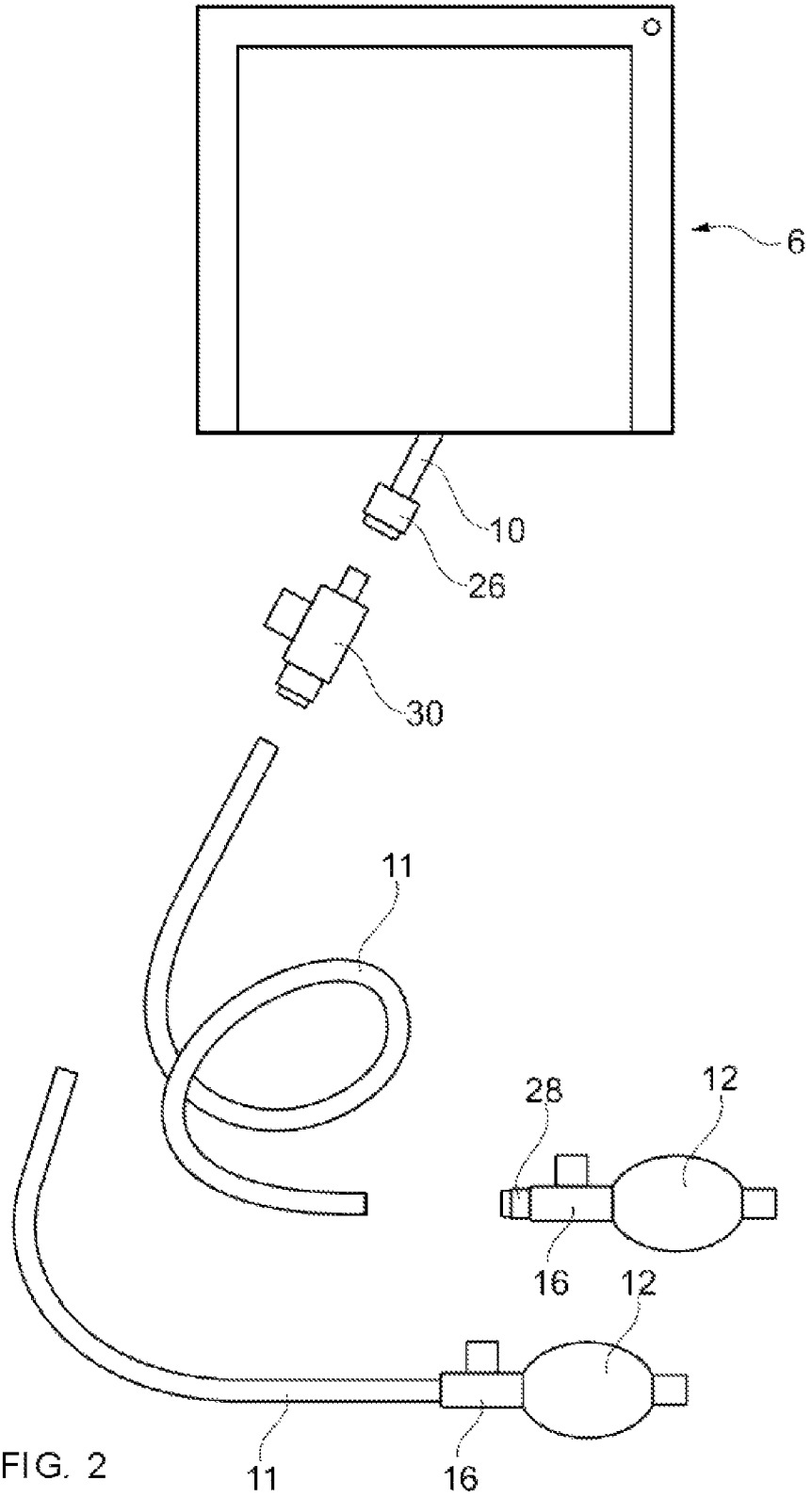
FIG. 2 illustrates different component of a device with an air cushion member.

FIG. 2 illustrates components for a system with an air cushion member 6. The cushion member 6 comprises a connector piece 10 with a quick-lock coupling element 26. A balloon 12 is provided for manual pumping and comprises a valve 16 in connection with a long hose 11. The long hose 11 may be shortened as needed. Optionally, with the valve 16, a hose quick lock coupling element 28 is provided for connection with the long hose 11. Optionally, between the hose 11 and the hose quick lock coupling element 26, a check valve 30 is provided which may be connected to the hose quick lock coupling element 26.

Figure 3A:
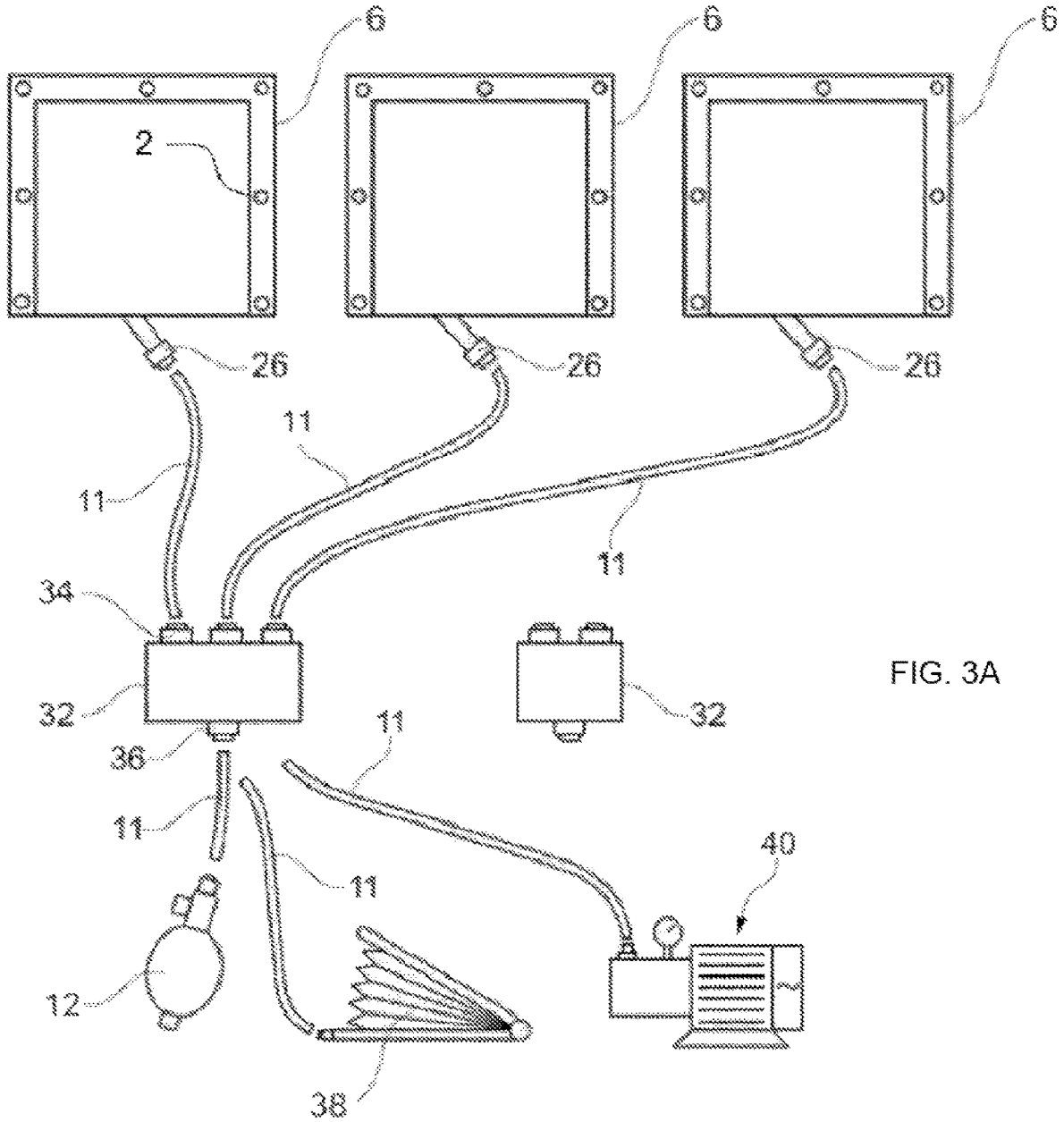
FIG. 3A illustrates various components for an air cushion member system.

In FIG. 3*a*, multiple air cushion members 6 are illustrated as part of a system with various other optional components for connection to various types of pumps, including a manual operated balloon 12, a foot pump with a bellows 38, or an electrical air pump 40. The components are illustrative for mutual connection, however, a selection of the components can also be taken as needed for a cushion member system. In addition, the number of cushion members 6 can be varied, as the number of three cushion members 6 is only an example. If multiple cushion members 6 are connected to a single one of these pumps 12, 38, 40, instead of having one pump for each cushion member 6, a manifold 32 is advantageously used with a single connector 36 to a pump 12, 38, 40 and multiple exits connectors 34, one for each connected cushion member 6. The manifold 32 may be embodied as a 2:1, 3:1, 4:1, 5:1, or 6:1 manifold or may even connect more cushion members to a single pump. In the drawing, without limitation to the number of connectable cushion members, manifolds for 3:1 and 2:1 connections are illustrated. The manifold 32 is provided with output connector pieces 34 which may be provided with hose quick lock coupling elements. The manifold comprises furthermore a hose connector piece 36 for the connection to hoses 11, which either can be connected to a balloon 12, or to a foot pump 38 or to an electric driven air pump 40.

It is also possible to use a T-piece instead of the two-channel manifold. A further alternative comprises a regulator instead of the manifold where the regulator is connected to a single pump, typically electrical pump 40, and configured for sequential filling of the connected cushion members 6, for example one after the other. The regulator optionally also comprises a valve system to empty the cushion members simultaneously or according to a predetermined deflation sequence, for example one after the other.

As illustrated in FIG. 3*a*, the cushion members 6 are provided with holes 2 in the edge region in order to bind multiple cushion members 6 together when stacked, for example with wires, clamps, or plastic strips, such as self-locking plastic strips. As the holes 2 are provided in the corners as well as on the edges, the cushion members can be bound together in various ways.

As illustrated in FIG. 3*a*, only three edges are provided with holes 2, because the cushion member 6 is provided as a bag unit by folding a sheet, as described above. However, it is also possible to weld or glue the sheets along all four edges, for example as illustrated in FIG. 7*a*. Holes are potentially provided at the corners, as shown in FIG. 7*a*; or only remotely from the corners; or at the corners as well as on the edges remotely from the corners, as illustrated in FIG. 3*a*.

Figure 3B:
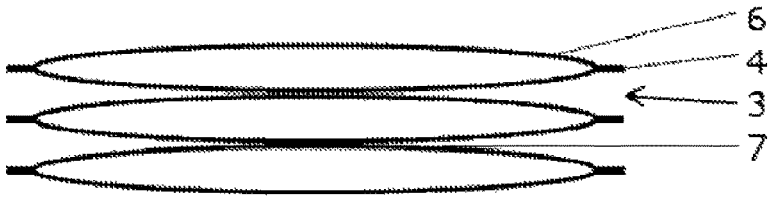
FIG. 3B illustrates a stack of the cushion members.

FIG. 3*b* illustrates a stack 3 with three cushion members 6, for example of the type as illustrated in FIG. 3*a*. In order for the cushion members 6 not to slide relatively to each other when stacked, various methods can be employed, as will be explained in further detail in the following. For example, the cushion members 6 are, provided with a high-friction surface 7, optionally a rubber surface, which makes them easily stackable with reduced risk for skidding.

Figure 4A:
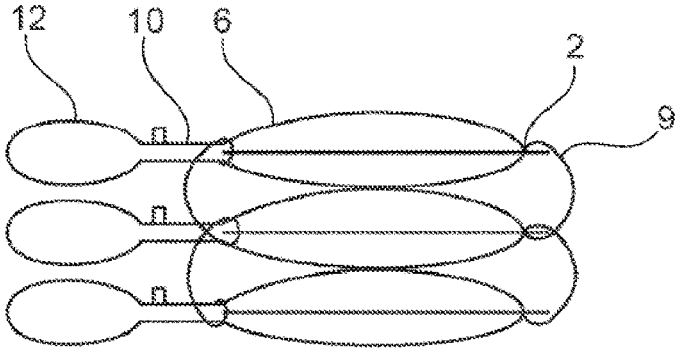
FIG. 4A illustrates a stack of cushion members bound together with wires or binder strips in a moderately inflated condition.
Figure 4B:
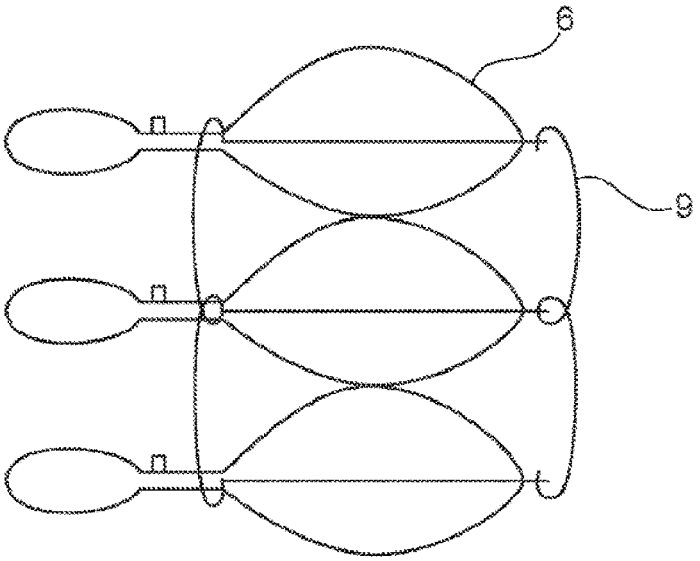
FIG. 4B illustrates a stack of cushion members bound together with wires or binder strips in a fully inflated condition.

FIG. 4*a* illustrates a stack of cushion members 6 that are bound together by coupling elements 9, for example wires, clamps, or strips, such as self-locking strips, extending through holes 2 in the edge region or in the corners for assembly and fixation of the stack. They are bound together at that edge or fold where also the connector piece 10 is provided or at the corresponding corner or corners of this edge or fold. They are also bound together at the opposite edge or corners. FIGS. 4*a* and 4*b* illustrate the stack with different degrees of inflation of the cushion members 6. For example, the cushion members are of the type as illustrated in FIG. 3*a* or of the type as illustrated in FIG. 7. Alternatively, as an option, the cushion members 6 in the stack are connected by telescopic rods extending through the holes 2.

Figure 5A:
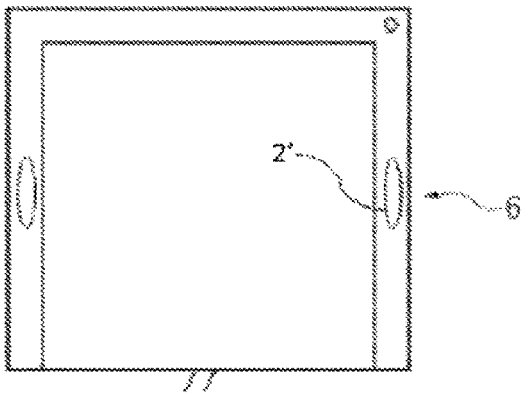
FIG. 5A illustrates an embodiment of cushion members with holes along the edge region for binding a stack together.
Figure 5B:
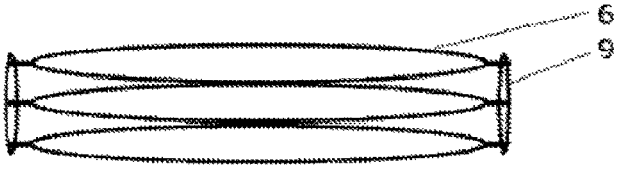
FIG. 5B illustrates an embodiment of cushion members bound together with wires or binder strips.

An alternative cushion member is illustrated in FIG. 5*a* with elongate holes 2' in the edge region other than the fold where the connector piece is provided. Such type of cushion member 6 would be bound with coupling elements through the holes 2' at those edges that are to the right and left of the connector piece 10. A stack of such cushion members is shown in FIG. 5*b* in an end view, which is from a side opposite to that edge or fold from which the connector piece 10 extends.

FIG. 6*a* illustrates a Velcro™ pad 8 on the flat sheet that constitutes one side of the cushion member 6. For example, the Velcro™ pad 8 is glued onto the sheet surface. In case that two cushion members 6 are provided with cooperating Velcro™ pads, one being provided with tiny loops and glued onto one cushion member 6 and the other Velcro™ pad with tiny hooks and glued onto another cushion member, the two pads can be brought in contact and cooperation between the hooks and loops, by which the two cushion members 6 are securely fastened to each other in a stack. Correspondingly, plural cushion members 6 can be provided in such stack, as illustrated in FIG. 6*b*, which is an end view, which means that the stack is seen from that side that is opposite to that edge or fold from which the connector piece 10 extends. FIGS. 6*c* and 6*d* illustrate a cushion member 6 stack in side view with different degrees of inflation.

FIG. 7*a* illustrates a cushion member with a high-friction surface. For example, polymer film sheet surface on one side, optionally a natural rubber surface or a synthetic rubber surface.

Some types of rubber exhibit an almost sticky surface towards glass and other smooth surfaces, thus having a high friction. Optionally, the polymer film sheet surface is rough or textured, for example with a corrugated surface. In some embodiments the surface comprises ridges and grooves across the sheet material. Such high friction surface is especially useful for smooth objects that are lifted, for example glass elements, such as doors, windows or mirrors. However, they are also useful in connection with lifting of furniture, household appliances, or cabinets, especially kitchen elements.

FIG. 7*b* illustrates the cushion member with a low-friction surface. An example is a smooth fabric, for example nylon fabric, optionally made of ballistic nylon yarn. Such smooth low friction surface for the cushion member is useful in situations where it is inserted into tight slits, where a sticky or rough surface of the cushion member would prevent insertion or at least make it difficult for the user. A smooth low friction sheet material is also useful for sliding of the cushion member over a surface, for example when lifted objects are dragged over a floor to a different location while being supported by one or more cushion members.

FIG. 7*c* illustrates two sheets 1, 1' which are to be joined along the edge region 4 in order to seal an inner volume 46 in between the sheets and form a cushion member of the type as in FIG. 7*a* or 7*b*. The first sheet material 1 is a laminate of a reinforcing fabric 45, for example nylon or polyethylene, and two layers of polymer film 44 sandwiching the reinforcing fabric 45 and providing air tightness. The second sheet material 1' is a laminate of a smooth reinforcing fabric 45 and a single layer of polymer film on only one side of the fabric. In the shown example in FIG. 7*c*, the upper layer of sheet material 1 comprises a polymer film 44 outwards. The other layer of sheet material 1' is oriented with the smooth fabric 45 outwards and the polymer film 44 inwards. Such a cushion member has one outer side with a smooth fabric 45 and one outer side with a polymer film 44 outwards. Whereas the smooth fabric 45 has a low friction, the polymer film 44 can be made of a high friction material, for example rubber. The user may then select the most appropriate side upwards and downwards, for example the polymer film 44 upwards and the smooth low-friction reinforcing fabrics 45 downwards in order to safeguard that the object for lifting is not sliding relatively to the cushion member and that the cushion member can easily slide across the floor. In this example, the drawings in FIG. 7*a* and FIG. 7*c* illustrate the two sides of the cushion member of FIG. 7*c*. Alternatively, the upper layer can also be provided as a two-layer laminate with only one layer of polymer film, which is then on the outer side of the upper sheet material. The polymer film can be provided with surface textures, such as knobs or corrugations as well. These principles of sheets can be used for sleeves, likewise.

The term low-friction versus high-friction is used herein as a friction of the surface of the sheet material against a smooth, hard surface, for example glass or ceramic tiles. The high-friction describes a friction with is higher than the low-friction. For example, if the cushion member is placed on a glass plate with the low friction surface against the glass surface and without additional weight on the cushion member, the cushion member is easily sliding over a glass plate, for example when giving the cushion member a short push onto its side. Even at a moderate manual push, the cushion can slide after the push for some time and some distance for example more than 50 cm from the position where the push was applied. In contrast thereto, if a cushion member is provided with a high-friction surface and is placed on such glass plate, a lateral push would not make the cushion slide correspondingly over the glass plate. Typically, the cushion member would stop and rest immediately after the push ends.

For the cushion member, various possibilities exist with respect to its surface in relation to smooth or rough, low-friction or high-friction. For example, both sides can be smooth, both sides rough, knobbed or corrugated or one side is smooth and one side rough, knobbed or corrugated in order to provide correspondingly low-friction or high-friction sides.

For example, a cushion member made with one rough or knobbed or corrugated, and one low-friction smooth side is very useful when lifting objects and dragging them on a surface. The high-friction side against an object assist in secure lifting of the object, for example furniture, glass elements, household appliances, or cabinets, with reduced risk for the object sliding down from the cushion member. The low friction side allows easy sliding of the cushion member on the support surface, such as a floor, while supporting the object that is pushed or dragged. The smooth sheet material allows sliding not only on smooth support surfaces, such as tile floors or wooden floors, but also on carpets.

FIG. 8*a* illustrates a further principle for lifting cushion members 6 in order to adjust the lifting level. In this embodiment, a support block 13 is provided underneath the cushion member 6. The support block 13 is provided with a hollow 15 inside which a cushion member 6 is accommodated when inflated or partially inflated. The hollow 15 provides a secure positioning of the cushion member 6 and prevents the cushion member 6 to slide sideways away from the block 13, especially when inflated and under pressure from a lifted object. A high friction surface towards the hollow 15 even decreases the risk for sliding out of the hollow 15. On the other hand, a high friction surface towards the object to lift safeguards that the cushion member 6 is not accidentally sliding away from the object. For example, the cushion member 6 comprises an outer sheet layer with a knobbed or corrugated surface, and this layer is oriented upwards in order to abut the object when lifting.

Optionally and as illustrated in FIG. 8*b*, in order to adjust the height, a plurality of extension plates 17 are provided along with the support block 13, the number of which is freely selectable in order to adjust the total height to a suitable level. Advantageously, the support plates 17, and optionally also the support black 13, are provided with a high-friction surface or alternatively with cooperating protrusions and indentations such that a mutual skidding among the plurality of support plates 17 is prevented. When such combination of cushion member 6 and support block 13 is used for lifting an object, for example a kitchen element, wardrobe, or other type of furniture, easy repositioning or moving is accomplished if the support block 13 is provided with an underside having a very low friction or with wheels 19, as illustrated in FIG. 8*c*. Alternatively, the lowest one of the support plates 17 is provided with wheels.

Typically, the extension plates 17 would be rigid, for example solid. However, elastic rubber slabs or even height-adjustable extension plates, for example by inflation, are also possible.

It is common for movers to use sleds with wheels when moving heavy furniture over shorter or longer distances. The supports block 13 with wheels 19 allows movers to lift objects to a higher point assisting quick and easy lifting and subsequent moving of the objects with lowered injury risk for the lifting person.

As alternatives to wheels, a variety of options exist for modification of the support block 13. For example, it comprises a plurality of cylindrical rollers 19' with parallel axes, as shown in FIG. 8*d* in side view and in FIG. 8*e* in perspective bottom view. Another example is ball rollers as illustrated in FIG. 8*f* in side view and in FIG. 8*g* in bottom view, where solid balls 19" are provided in corresponding ball bearings 43 such that less than half of the ball is 19" extending out of the bearing for rolling onto a ground support, while the remaining part of the ball 19" is maintained in the bearing 43. As the bearing 43 embraces more than half of the ball 19', it fixes the ball 19" inside the bearing 43 but lets it rotate freely. One of two continuous tracks 41 on rollers is illustrated in FIG. 8*h*, by which the support block 13 can move on the grounds like a tank, being less dependent on smoothness of the ground. Optionally, as illustrated in FIG. 8*i*, the continuous tracks 41 on the rollers 19''' are provided with soft lamella 42, for example rubber lamella. FIG. 8*j* discloses a support block with rollers 19 and a flat hollow 15 for the air cushion member 6.

In an advanced embodiment, the rollers or continuous track are electrically driven, for example by a wired or wireless remote controlled motor 55.

Instead of providing the cushion member 6 with a high-friction or low-friction surface, as explained in connection with FIG. 7, a different solution is found in the following.

FIG. 9*a* illustrates a cushion member 6 and a sleeve 21 with an opening 27 for insertion of a cushion member 6 into a cavity inside the sleeve 21. Optionally, the sleeve 21 has a cut-out 23 for accommodating the connector piece 10. For example, such sleeve 21 is provided with a surface material that deviates from the surface material of the cushion member 6, which allows for adaptation to the desired surface characteristics of such cushion member 6.

For example, a plurality of sleeves 21 with mutually different surfaces and different surface friction combinations are provided in order to select the most useful sleeve 21 for a given purpose, while using a single type of cushion member 6. This has the advantage of supplemental sale and improvement of versatility of already existing cushion members 6, especially for a user who already has purchased air cushion members 6 and has a need for extending the versatility thereof without the need of exchanging the air cushion member 6 itself. Especially, it is pointed out that the production costs and sale price for the sleeves 21 are, typically, lower than for an air cushion member in that no pump 12 and valve arrangement 16 is needed.

FIG. 9*b* illustrates an embodiment of such sleeve 21 comprising a first flexible sheet 21*a* forming a first sleeve side with a smooth outer surface 29*a*, for example with a low-friction, easy-to-slide surface material. FIG. 9*c* illustrates an embodiment of such sleeve 21 with a second flexible sheet 21*b* forming a second sleeve side having a high-friction anti-skid material, for example a corrugated outer surface 29*b* of a flexible material, optionally natural or synthetic rubber material. FIG. 9*d* illustrates the corrugated surface 29*b* in greater detail.

As for the cushion member 6, various possibilities exist with respect to the surface of the sleeve 21 in relation to smooth or rough, low-friction or high-friction. For example, both sides can be smooth, both sides rough or knobbed or corrugated or one side is smooth and one side rough or knobbed or corrugated in order to provide correspondingly low-friction or high-friction sides. The examples and arguments for insertion into narrow slits, for lifting objects and for dragging and sliding apply in this case equally well as explained in connection with the various surfaces of the cushion member itself.

For example, using a cushion member 6 or a sleeve 21 with a knobbed or corrugated surface on both sides, such as continuous grooves across the element, is useful for lifting, positioning and leveling thin elements such as glass elements, glass panes, on top of it without risking these thin elements from sliding off the cushion member or this cushion member to move unintentionally over the support surface and cause damage.

It should also be mentioned that the combination of a smooth side and a rough or knobbed or corrugated high-friction side is useful when stacking several cushion members, for example as illustrated in FIG. 3*b*. This is not only valid when the cushion member 6 itself is provided with a low-friction and a high-friction side but also when sleeves 21 are used. In this case, the coupling elements 9 or the Velcro™ pads 8 are not strictly necessary.

Various examples of sleeves are illustrated in FIG. 9*e* through 9*k*. FIG. 9*e* illustrates a sleeve with a functional surface 29*c* that comprises a fabric or Velcro™ surface on at least one side 21*c* of the sleeve for easy sliding on a smooth support. FIG. 9*f* illustrates a functional surface that 29*c* that is heat resistant and/or fire retardant on at least one side 21*c* of the sleeve for use in environments where heat, open fire or welding is present. FIGS. 9*g* and 9*h* illustrate a sleeve with at least one side 21*c* comprising elongate, protruding profiles 48 in diagonal or longitudinal direction, respectively. Such elongate protruding profiles also optionally function as stiffeners. For example, the elongate, protruding profiles 48 are made of stiff but flexible rubber, plastic or metal. These elongate, protruding profiles also provide a frictional corrugated surface against skidding. Especially, such elongate, protruding profiles function as locking profiles so that edges of lifted elements, for example furniture, doors or windows during mounting or transport do not slide off the surface. FIG. 9*i* illustrates a surface 21*c* comprising a magnet 49 or being provided with a functional magnetic surface 49' for fastening to metal surfaces, especially surfaces containing iron, or on magnetic surfaces. FIG. 9*j* illustrates a surface 21*c* with a suction cup 50.

Alternatively, especially for high friction against glass, at least one of the surfaces is provided with a synthetic dry adhesive polymer 51, as illustrated in FIG. 9*k*. Such adhesives are known from nature to mimic the feet of geckos, seeing that geckoes can crawl along vertical walls as well as upside down on ceilings. Examples of dry adhesives are disclosed in U.S. Pat. No. 7,762,362 and German patent application DE201510101290. Micro-structured dry adhesives are generally described and discussed in US2008/169003, US2014272272, and U.S. Pat. No. 8,882,996, referring to electrostatic and Van der Waals forces. In US2014272272, it is explained with reference to gecko feet that dry adhesives commonly use asymmetric micro-structured hairs that create a high area of contact when loaded in a preferred direction. When the load is reversed, the adhesives release from the surface with near zero force. Correspondingly, such functional surface, when flat against a support is solidly secured to the support against sliding but can easily be removed from the support by lifting the sleeve off the surface, starting with one corner or edge and dragging the remaining part of the sleeve 21 along.

In order to improve the height adjustment or width adjustment when using a cushion member or a stack of cushion members, a practical solution has been found, as illustrated in FIG. 10*a*, in providing a pouch 5 with two flat, rigid plates 47*a*, 47*b* connected by an elastic belt 31 along the circumference. The elastic belt 31 can be smooth and resilient, as illustrated in FIG. 10*a*, or alternatively, an elastic zig-zag belt 31', like a bellows, as illustrated in FIG. 10*b*. When one or more cushion members 6 are inserted into a cavity of such pouch 5, inflation of the cushion member 6 or members will cause the two rigid plates 47*a*, 47*b* being pressed apart, which increases the distance between the two rigid plates 47*a*, 47*b*. The expansion by the two rigid 47*a*, 47*b* plates being pressed apart is indicated by arrow 33. Such a system is especially useful for lifting and generally pressing apart objects with irregular surface. Whereas a cushion member 6 would potentially adjust to the irregular surface or even get punctured and not perform the necessary lifting or pushing action, the rigid plates 47*a*, 47*b* result in a stiff interface with well-defined distance over a relatively large surface, why such pouch 5 improves the action of increased height adjustment as compared to a flexible cushion member 6 in case of irregular surfaces.

Similarly as explained in relation to FIG. 9, the surface of at least one of the rigid plates 47*a*, 47*b* of the pouch 5 can be provided with various functional surfaces 29*c* and with special characteristic features, such as [0156] a fabric or Velcro™ surface for easy sliding on a smooth support, see FIG. 10*c;* [0157] elongate, protruding profiles 48 in diagonal or longitudinal direction, see FIG. 10*d* and FIG. 10*e;* [0158] magnets 49 or a functional magnetic surface 49', see FIG. 10*f;* [0159] suction cups 50, see FIG. 10*g;* [0160] a synthetic dry adhesive polymer 51', see FIG. 10*h;* [0161] indentations or holes 53 for securely stacking to another pouch 5 or distance plate which has cooperating pins fitting into the indentations or holes 53; see FIG. 10*i*; the pouch optionally comprising wheels 19.

In order to improve the height adjustment or width adjustment when using a cushion member or a stack of cushion members 6, an alternative practical solution has been found, as illustrated in FIG. 11*a*, in providing a pouch 5 formed by one rigid plate 47*a* with an edge region to which a flexible sheet material 21*b* is fastened. The flexible sheet 21*b* is extending from edge to edge of the rigid plate 47*a* across the width of the rigid plate 47*a* so to form a cavity between the rigid plate 47*a* and the flexible sheet material 21*b* for insertion of a cushion member 6. The cushion member 6 is provided inside the cavity of the pouch 5 for by inflation of the cushion member 65 causing the rigid plate 47*a* and the flexible sheet 21*b* to be pressed away from each other for increasing the distance between the rigid plate 47*a* and the flexible sheet 21*b*.

Also, such a system is especially useful for lifting and generally pressing apart objects with irregular surface. Whereas a cushion member 6 would potentially adjust to the irregular surface or even get punctured and not perform the necessary lifting or pushing action, the rigid plate 47*a* results in a stiff interface with well-defined distance over a relatively large surface, why such pouch 5 improves the action of increased height adjustment as compared to a flexible cushion member 6 in case of irregular surfaces.

Similarly as explained in relation to FIG. 9, the surface of the rigid plate 47*a* or the flexible sheet 21*b* can be provided with various functional surfaces 29*c*, see FIG. 11*a*, for example with a synthetic dry adhesive polymer 51, as explained above. Other potential special characteristic surface features are [0165] a fabric or Velcro™ surface for easy sliding on a smooth support, see FIG. 11*b;* [0166] elongate, protruding profiles 48 in diagonal or longitudinal direction, see FIG. 11*c* and FIG. 11*d;* [0167] magnets 49 or a functional magnetic surface 49', see FIG. 11*e;* [0168] suction cups 50, see FIG. 111; [0169] indentations or holes 53 for securely stacking to another pouch 5 or distance plate which has cooperating pins fitting into the indentations or holes 53; see FIG. 11*g* the pouch optionally comprising wheels 19.

FIG. 12*a* and FIG. 12*b* illustrate a support block 13 with a rigid plate 47*a* guided by cooperating guiding pins 53 and guiding holes 54. Optionally, the guiding pins are telescopic. FIG. 12*a* shows the support block in a collapsed state, and FIG. 12*b* illustrates a state where an air cushion is inserted between the support block 13 and the rigid plate 47*a*. The pins 53 are optionally used to keep the air cushion member from sliding out of the support block 13. For example, the pins 53 are extending through openings 2 in the air cushion member, for example openings 20 as illustrated in FIGS. 3*a* and 7. This is an embodiment, in which a cushion member is secured against sliding by using the holes 2 in the edge regions or corners of the cushion member.

Alternatively, or in addition to the pins 53 extending through holes 2 of the cushion member, a hollow 15 can be provided in the support block 13. FIG. 12*c* illustrates an embodiment where the support block 13 comprises a hollow 15 for securing the air cushion member 6 against sliding off the support block 13. In FIG. 12*d*, the support block is shown with wheels 19, similarly to the embodiment in FIG. 8*c*. FIG. 12*d* illustrates an alternative with a flat support block 14 comprising wheels 19. Alternatively, ball rollers or continuous tracks, similarly to the ones illustrated in the drawings of FIG. 8*d* through 8*i* are used. The support block 13 has a flat shallow hollow for supporting and securing the air cushion member 6. Also, in this case, the pins are optionally used for extending through holes 2 in the cushion member.

FIG. 13 illustrates an alternative air pump 39 connected via a hose 11 to the cushion member 6. The air pump 39 is provided with an inflation button and a deflation button, illustrated by a plus sign and a minus sign. The pump 39 is small and battery-powered. The pump can provide a pressure of up to 2 bars, optionally 3 bars, which is far above the power that a typically human can press into the cushion member 6 with a simple balloon 12 as illustrated above, where the typical pressure is rather between 0.8 bar and 1.2 bar, and only up to 1.6 bar for strong users. Also, it eases operation for a user if multiple inflation-deflation sequences are necessary, especially for windows installer or furniture movers. Also, such pump 39 eases precise adjustment/levelling. As seen, the dimensions of the pump 39 are smaller than the width of the cushion member, which is typically 10-20 cm, and within a circumscribed circle of 30 cm.

NUMBER LIST

1 first sheet material of cushion member 6
1' second sheet material
2 holes in edge region 4
2' elongate holes
3 stack of air cushion members
4 edge region of cushion member 6
5 pouch
6 inflatable air cushion member
7 friction rubber surface
8 Velcro™ pad
9 coupling element through 2 holes in edge region
10 connector piece
11 long hose
12 balloon
13 support block

14 intake valve of balloon 12
15 hollow in support block 13
16 deflation valve
17 height extension plates
18 actuator button for deflation
19 wheels for support block 13
19' cylindrical rollers in support block 13
19" ball rollers in support block 13
19''' rollers for a continuous track
20 corner hole
21 sleeve
21*a* first flexible sheet material
21*b* second flexible sheet material
21*c* sleeve side with functional surface 29*c*
22 welding
23 cutout of sleeve 21
24 fold of air cushion
26 quick lock coupling element at cushion member
27 sleeve insert opening
28 coupling element as balloon
29*a* smooth surface on first flexible sheet material 21*a* of sleeve 21
29*b* corrugated surface on second flexible sheet material 21*b* of sleeve 21
29*c* functional surface
30 check valve
31 flexible belt
31' flexible bellows belt
32 manifold
33 arrow indicating expansion of belt 31
34 output connector piece of manifold 32
36 hose connecting connector piece
38 foot pump
39 hand-held air pump
40 air pump
41 continuous track on rollers 19'''
42 soft lamella on track 41
43 ball bearings for ball rollers 19'
44 air tight layer of sheet material 1
45 smooth reinforcing fabric of sheet material 1
46 inner volume of cushion member
47*a* upper rigid plates of pouch 5 or block 13
47*b* lower rigid plate of pouch 5
48 elongate, protruding profiles on surface
49 magnet
49' magnetic surface
50 suction cup
51' dry adhesive polymer
52 indentations
53 guiding holes for pins 54
54 pins cooperating with guiding holes 53
55 electrical motor

The invention claimed is:

1. A device for positioning an object relatively to a support, the device comprising at least one inflatable air cushion member of a flexible but non-stretchable air tight sheet material in hose-connection with an inflation tool; wherein the cushion member is formed as a bag unit comprising a first sheet material and a second sheet material provided face to face and joined along an edge region to form a double layer edge; wherein the bag unit is flat in deflated condition and attains a rounded shape in inflated condition, wherein the device further comprises a support block that has an upper hollow in the form of a cavity, the cavity partly accommodating the cushion member, so that a part of a lower half of the cushion member is contained in the hollow and supported when the cushion member is inflated.

2. A device according to claim 1, wherein the cushion member in deflated condition is rectangular with en edge length of 12-19 cm; and wherein the double-foil has a thickness of less than 2 mm, wherein the sheet material of the cushion is a polymer foil reinforced by fibers.

3. A device according to claim 2, wherein the air cushion member comprises a folded rectangular piece of a sheet material such that a fold constitutes one edge of the rectangle and the remaining edge region constitutes three other edges of the rectangle that are welded or glued together, wherein at the fold, there is provided a foot piece of an outwardly protruding bendable connector piece connected to the inflation tool, which is a balloon configured for manual operation by squeezing of the balloon by hand and comprising an intake check valve, wherein a deflation valve is provided at the balloon with an actuator button for deflation of the cushion member.

4. A device according to claim 1, wherein the first sheet material comprises a first outer sheet layer, which is outwards directed, on a first side of the cushion member and the second sheet material comprises a second outer sheet layer, which is outwards directed, on an opposite side of the cushion member, wherein the first outer sheet layer has a higher friction when measured against glass than the second outer sheet layer.

5. A device according to claim 2, wherein the first sheet material comprises a first outer sheet layer, which is outwards directed, on a first side of the cushion member and the second sheet material comprises a second outer sheet layer, which is outwards directed, on an opposite side of the cushion member, wherein the first outer sheet layer has a higher friction when measured against glass than the second outer sheet layer.

6. A device according to claim 3, wherein the first sheet material comprises a first outer sheet layer, which is outwards directed, on a first side of the cushion member and the second sheet material comprises a second outer sheet layer, which is outwards directed, on an opposite side of the cushion member, wherein the first outer sheet layer has a higher friction when measured against glass than the second outer sheet layer.

7. A device according to claim 4, wherein the first outer sheet layer is a polymer film layer and the second outer sheet layer is a smooth fabric layer.

8. A device according to claim 4, wherein the first outer sheet layer is a polymer film layer with a knobbed or corrugated surface.

9. A device according to claim 4, wherein the second sheet material comprises a smooth fabric that is covered with an air tight polymer film layer on only one side of the fabric, and the polymer film layer is facing inwards towards an air volume inside the air cushion member, whereas the smooth fabric layer is facing outwards in order to yield a low friction surface on the second outer sheet layer on one side of the cushion member.

10. A device according to claim 1, the device comprising a support block in combination with a rigid plate and the cushion member between the support black and the rigid plate, the rigid plate comprising perpendicularly extending pins, and the support block being provided with guiding holes for accommodating the guiding pins for securing the rigid plate from sliding off the support block.

11. A device according to claim 10, wherein the guiding pins extend through holes in edge regions of the cushion member for securing the cushion member from sliding off the support block.

12. A device according to claim 1, wherein the support block comprises a fabric or Velcro™ surface on its underside for easy sliding on a smooth support or a polished polymer surface on its underside for easy sliding on a carpet.

13. A device according to claim 1, wherein the support block comprises continuous tracks, rollers, or wheels, for example swivel wheels, for easy maneuvering.

14. A device according to claim 1, further comprising a plurality of support plates, and the support block being provided on top of the plurality of support plates in stacked condition; wherein the support plates are provided with high-friction surfaces, selected among rubber surfaces and surfaces with cooperating protrusions and indentations, for preventing sliding relatively to each other.

15. A device according to claim 14, wherein the plurality of stacked support plates comprises a lowest plate that has a lower friction on an underside than on an upper side when measured against glass.

* * * * *